US012048408B2

(12) United States Patent
Kim et al.

(10) Patent No.: US 12,048,408 B2
(45) Date of Patent: Jul. 30, 2024

(54) DISH WASHER

(71) Applicant: LG Electronics Inc., Seoul (KR)

(72) Inventors: Seungyoun Kim, Seoul (KR); Kyung Rae Kim, Seoul (KR); Min Jae Jeong, Seoul (KR); Jeong In Kim, Seoul (KR); Kijoong Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 134 days.

(21) Appl. No.: 17/508,430

(22) Filed: Oct. 22, 2021

(65) Prior Publication Data

US 2022/0125277 A1 Apr. 28, 2022

(30) Foreign Application Priority Data

Oct. 22, 2020 (KR) ..... 10-2020-0137868

(51) Int. Cl.
*A47L 15/48* (2006.01)

(52) U.S. Cl.
CPC ..... *A47L 15/486* (2013.01); *A47L 2501/10* (2013.01); *A47L 2501/12* (2013.01)

(58) Field of Classification Search
CPC ..... A47L 15/486
See application file for complete search history.

(56) References Cited

U.S. PATENT DOCUMENTS

2010/0300499 A1 12/2010 Han et al.

FOREIGN PATENT DOCUMENTS

| | | | | |
|---|---|---|---|---|
| DE | 102013223940 | | 4/2015 | |
| DE | 102014215933 | | 3/2016 | |
| DE | 102015212863 | | 1/2017 | |
| DE | 102015212869 | | 1/2017 | |
| DE | 102015212880 | | 1/2017 | |
| DE | 102015212880 | A1 * | 1/2017 | |
| EP | 3114979 | | 1/2017 | |
| EP | 3114979 | A1 * | 1/2017 | ..... A47L 15/481 |
| EP | 3114979 | | 8/2019 | |

OTHER PUBLICATIONS

Machine translation of DE-102013223940-B3, dated Apr. 2015. (Year: 2015).*
Machine translation of EP-3114979-A1, dated Jan. 2017. (Year: 2017).*
Machine translation of DE-102015212880-A1, dated Jan. 2017. (Year: 2017).*
Extended European Search Report in European Appln. No. 21204150.3, dated Mar. 21, 2022, 6 pages.

* cited by examiner

*Primary Examiner* — Joseph L. Perrin
*Assistant Examiner* — Kevin G Lee
(74) *Attorney, Agent, or Firm* — Fish & Richardson P.C.

(57) ABSTRACT

A distribution cap is configured to couple to a nozzle of a dish washer and to guide air from the nozzle to be discharged in a discharge direction. The distribution cap includes a fitting pipe configured to couple to the nozzle, a first bypass pipe that is connected to the fitting pipe and extends in a direction different from the discharge direction, where the first bypass pipe is configured to be positioned above the nozzle based on the fitting pipe being coupled to the nozzle, and a second bypass pipe that extends from an end portion of the first bypass pipe in the discharge direction, where the second bypass pipe defines a discharge opening at an end portion thereof.

20 Claims, 22 Drawing Sheets

DISH WASHER

CROSS-REFERENCE TO RELATED APPLICATION

This application claims priority to and the benefit of Korean Patent Application No. 10-2020-0137868, filed on Oct. 22, 2020, the disclosure of which is incorporated herein by reference in its entirety.

TECHNICAL FIELD

The present disclosure relates to a dish washer, and more specifically, to a dish washer in which a drying unit is disposed under a tub and dry air is introduced into the tub through a nozzle installed in a bottom of the tub.

BACKGROUND

A dish washer may include a cabinet defining an overall exterior, a base that is installed under the cabinet and defines a bottom of the dish washer, a tub that accommodates racks for holding dishes, a washing unit that sprays wash water to the tub at relatively high pressure to wash the dishes, and a drying unit that dries the washed dishes.

In some cases, the dish washer may include a sump for collecting and recirculating the wash water and a drain unit for draining used wash water, where the sump and the drain unit may be provided in a space between the tub and the base. In some cases, the drying unit may be also provided in the space between the tub and the base.

In some examples, the dish washer may have a structure in which a drying unit is disposed at a lower level than a tub and supplies dry air heated by the drying unit into the tub through a nozzle passing through a bottom of the tub.

In some cases, where a discharge end portion of the nozzle is exposed at a washing space, wash water may be introduced into the drying unit through the discharge end portion of the nozzle during a dish washing process. In some cases, a cap may be installed on an outer circumferential surface of the nozzle to hide the discharge end portion of the nozzle from the washing space to help prevent the phenomenon. For instance, the cap may surround the discharge end portion of the nozzle in a state in which the cap is spaced apart from the discharge end portion so that the cap may not hinder the dry air from being discharged from the discharge end portion of the nozzle.

In some examples, the dry air supplied through the nozzle may be finally discharged to an inner space of the tub, and the cap may include a discharge opening for discharging the air. In some cases, the wash water may be introduced through the discharge opening of the cap.

In some examples, the dish washer may have a structure of blocking a region close to the discharge opening of the cap in a region of the discharge end portion of the nozzle.

In some cases, where the blocking structure for blocking the wash water from permeating into the nozzle is applied to the discharge end portion of the nozzle, directivity issues of the nozzle in a circumferential direction of the nozzle may be raised. For example, if the nozzle has a circular pipe shape and the discharge end portion of the nozzle has the blocking structure, there may be cumbersomeness in arranging a direction of the blocking structure with a predetermined direction during an installation of the nozzle in the tub.

In some cases, the nozzle may be installed by inserting the discharge end portion of the nozzle upward so that the discharge end portion passes through the bottom of the tub from a space provided under the tub. In this case, when the blocking structure of the discharge end portion of the nozzle has an area greater than an area of the pipe shape of the nozzle, the nozzle may not be inserted into the tub, and thus the nozzle may be difficult to install. Accordingly, the blocking structure of the exposed end portion may be designed to be smaller than the area of the pipe shape of the nozzle, which may lead to a decrease of a flow cross-sectional area of the end portion of the nozzle and a flow loss.

In some cases, the cap may have a structure in which a flow direction of the dry air is changed by 90 degrees to 180 degrees several times, and an air flow is divided, which may lead to an increase of flow resistance and flow loss.

SUMMARY

The present disclosure further describes a distribution cap of a nozzle to help prevent wash water from being introduced into the nozzle and allow the nozzle to be easily installed.

The present disclosure further describes a distribution cap that can reduce a flow resistance by increasing a discharge area of a nozzle.

The present disclosure further describes a distribution cap having an inner structure that guides a flow direction of dry air discharged from a nozzle without a suddenly change to thereby minimize flow resistance.

The present disclosure further describes a dish washer in which the distribution cap is installed on a nozzle.

According to one aspect of the subject matter described in this application, a distribution cap is configured to couple to a nozzle of a dish washer and to guide air from the nozzle to be discharged in a discharge direction. The distribution cap includes a fitting pipe configured to couple to the nozzle, a first bypass pipe that is connected to the fitting pipe and extends in a direction different from the discharge direction, where the first bypass pipe is configured to be positioned above the nozzle based on the fitting pipe being coupled to the nozzle, and a second bypass pipe that extends from an end portion of the first bypass pipe in the discharge direction, where the second bypass pipe defines a discharge opening at an end portion thereof.

Implementations according to this aspect can include one or more of the following features. For example, the fitting pipe can include a sidewall, which includes (i) a fitting section configured to engage with the nozzle and (ii) an upper section that extends upward from the fitting section and defines an open part that is open in a direction different from the discharge direction. The fitting pipe can include an upper end cover that covers the upper section of the sidewall, and the first bypass pipe can be connected to the fitting pipe and in fluid communication with the open part of the upper section of the sidewall.

In some implementations, the first bypass pipe can define an inner space and include a first bottom surface that defines a lower limit of the inner space of the first bypass pipe, where the first bottom surface extends along an extension direction inclined downward with respect to a horizontal plane.

In some implementations, the first bypass pipe can define an inner space and include a first outer circumferential surface that faces the inner space of the first bypass pipe and defines a first portion of an outer circumference of the first bypass pipe, and a first inner circumferential surface that defines a second portion of the outer circumference of the first bypass pipe, where the first inner circumferential surface is disposed radially inward relative to the first outer circumferential surface, and a length of the first outer circumferential surface is greater than a length of the first inner circumferential surface.

In some examples, the first bypass pipe can further include a connecting portion connected to the fitting pipe, where a distance between the first outer circumferential surface and a center of the fitting pipe can increase in a direction away from the connecting portion. In some examples, the first outer circumferential surface can include a first convex section and a first concave section, where the first convex section is disposed between the connection portion and the first concave section. In some examples, the first outer circumferential surface can further include a first inflection section that linearly extends between the first convex section and the first concave section.

In some implementations, the first bypass pipe can extends in a first lateral direction that intersects the discharge direction.

In some implementations, the second bypass pipe can define an inner space thereof and include a bottom surface that defines a lower limit of the inner space of the second bypass pipe, where the bottom surface of the second bypass pipe extends along an extension direction inclined downward with respect to a horizontal plane. In some examples, the first bypass pipe can define an inner space thereof and include a bottom surface that defines a lower limit of the inner space of the first bypass pipe, where the bottom surface of the first bypass pipe is inclined downward with respect to the horizontal plane and extending in a first lateral direction intersecting the discharge direction. The bottom surface of the second bypass pipe can be inclined downward with respect to the horizontal plane in each of the first lateral direction and the discharge direction, and the bottom surface of each of the first bypass pipe and the second bypass pipe defines an inclination angle inclined downward with respect to the horizontal plane in the first lateral direction.

In some examples, an upper surface of the second bypass pipe can define an upper limit of the inner space of the second bypass pipe, where the upper surface of the second bypass pipe extends in the discharge direction and defines an upper inclination angle inclined with respect to the horizontal plane. The bottom surface of the second bypass pipe can extend in the discharge direction and define a lower inclination angle inclined with respect to the horizontal plane, where the lower inclination angle is greater than the upper inclination angle.

In some implementations, the second bypass pipe can define an inner space and include an upper surface that defines an upper limit of the inner space of the second bypass pipe, and an eave that is disposed at an end portion of the upper surface of the second bypass pipe and extends in the discharge direction.

In some examples, the second bypass pipe can define an inner space and include an outer circumferential surface that defines a first portion of an outer circumference of the second bypass pipe and faces the inner space of the second bypass pipe, and an inner circumferential surface that defines a second portion of the outer circumference of the second bypass pipe, where the inner circumferential surface is disposed radially inward relative to the outer circumferential surface, and a length of the outer circumferential surface of the second bypass pipe is greater than a length of the inner circumferential surface of the second bypass pipe.

In some implementations, the second bypass pipe can further include a connecting portion connected to the first bypass pipe, where a distance between the outer circumferential surface of the second bypass pipe and a center of the end portion of the first bypass pipe increases in a direction away from the connecting portion. In some examples, the outer circumferential surface of the second bypass pipe can include a convex section and a concave section, where the convex section is disposed between the connecting portion and the concave section.

In some examples, the inner circumferential surface of the second bypass pipe can have a concave profile. For instance, the inner circumferential surface of the second bypass pipe is curved to expand at least a partial section from the discharge opening.

In some implementations, the second bypass pipe can further include an outer vane and an inner vane that are disposed between the outer circumferential surface of the second bypass pipe and the inner circumferential surface of the second bypass pipe. The outer vane can define a profile corresponding to the outer circumferential surface of the second bypass pipe and be disposed at a position closer to the outer circumferential surface of the second bypass pipe than the inner circumferential surface of the second bypass pipe. The inner vane can define a profile corresponding to the inner circumferential surface of the second bypass pipe and be disposed at a position closer to the inner circumferential surface of the second bypass pipe than the outer circumferential surface of the second bypass pipe.

In some implementations, the first bypass pipe can define a first inner space and include a first upper surface that defines an upper limit of the first inner space, and the second bypass pipe can define a second inner space and include a second upper surface that defines an upper limit of the second inner space, where the second upper surface extends in the discharge direction and is inclined downward with respect to a horizontal plane. The first upper surface can be disposed above the second upper surface, and the distribution cap can further include a transition section that connects the first upper surface and the second upper surface. The transition section can define a streamlined shape at a boundary between the first upper surface and the second upper surface. In some examples, the distribution cap can define a drain hole at a bottom region facing the transition section.

In some implementations, a nozzle of a dish washer may not include a structure that can block an opening of an upper end portion of a nozzle to help prevent wash water from being introduced into the nozzle. Accordingly, since the nozzle does not have a directivity, the nozzle can be easily installed, and since a resistance against a flow of dry air discharged from the nozzle may not be generated, a discharge amount of dry air of the distribution cap can be sufficiently secured.

In some implementations, since the dry air can be discharged from the nozzle in a swirl shape, while a direction of the flow of the dry air is not changed sharply or the flow does not branch off, the wash water can be prevented from being introduced into the nozzle.

In some implementations, the nozzle can discharge the dry air in the swirl shape, and can widely diffuse and discharge the dry air.

In some implementations, since the upper end portion of the nozzle may not be blocked to prevent infiltration of the water, the large discharge amount of the dry air can be secured.

DETAILED DESCRIPTION

Hereinafter, one or more implementations of the present disclosure will be described in detail with reference to the accompanying drawings.

In this application, a direction in which a door is installed with respect to a center of a dish washer in a state in which the dish washer is placed on a floor for use is defined as a forward direction. Accordingly, a direction toward an interior of the dish washer when the door is opened becomes a rearward direction. For the sake of convenience, the forward and rearward directions can be referred to as a first direction. Then the forward direction can be referred to as one direction of the first direction, and the rearward direction can be referred to as the other direction of the first direction.

In addition, a gravity direction can be defined as a downward direction, and a direction opposite to the gravity direction can be referred to as an upward direction.

In addition, a horizontal direction, that is, a width direction of the dish washer when the dish washer is viewed from in front of the door of the dish washer, perpendicular to the forward and rearward directions can be referred to as a left-right direction. For the sake of convenience, the left-right direction can be referred to as a second direction. Then, a right direction can be referred as one direction of the second direction, and a left direction can be referred to as the other direction of the second direction.

In addition, the above described upward and downward directions can be referred to as a third direction. Then, the upward direction can be referred to as one direction of the third direction, and the downward direction can be referred to as the other direction of the third direction.

Figure 1:
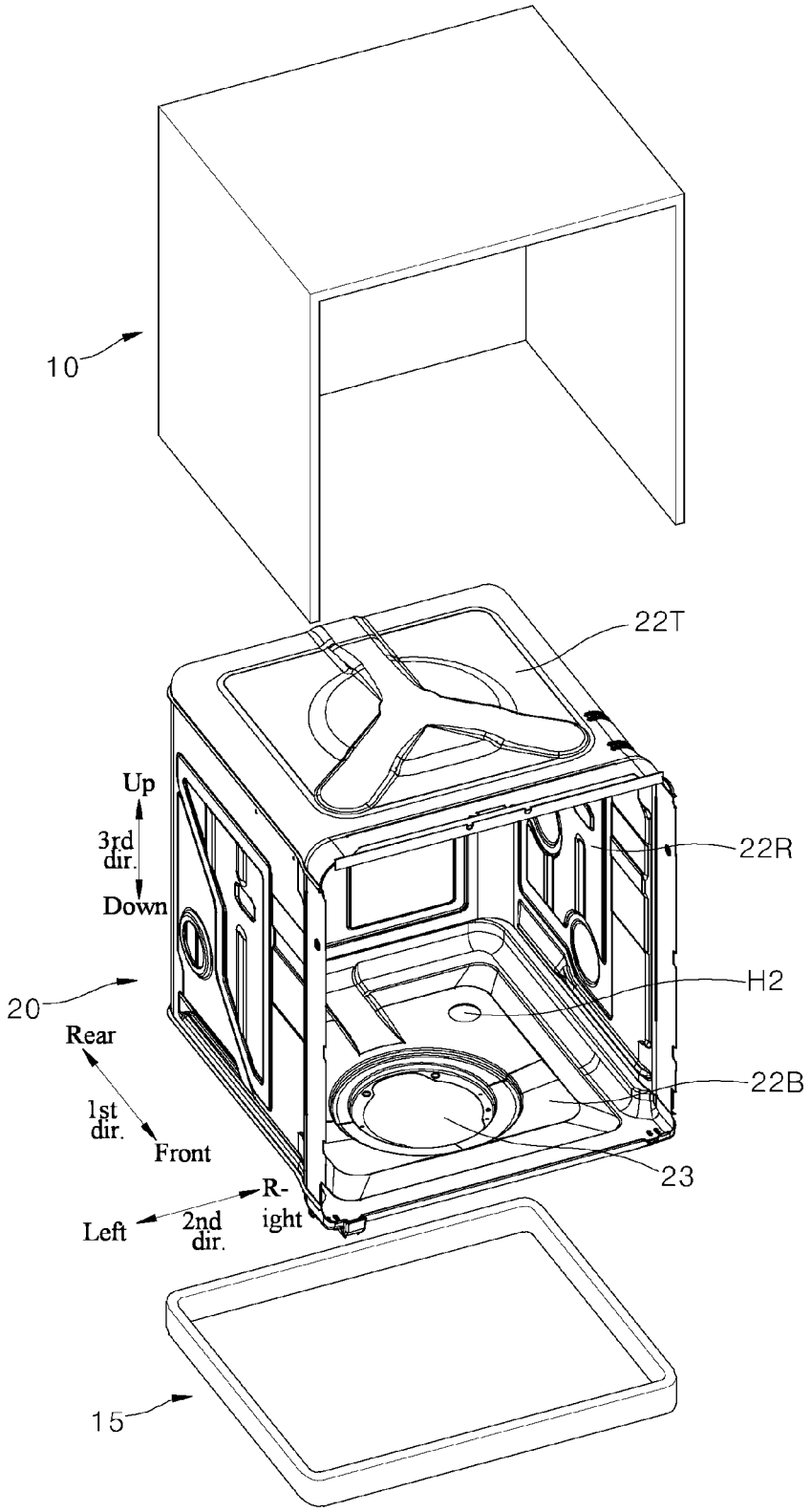
FIG. 1 is an exploded perspective view illustrating an example of a dish washer including a cabinet, a tub, and a base.
Figure 2:
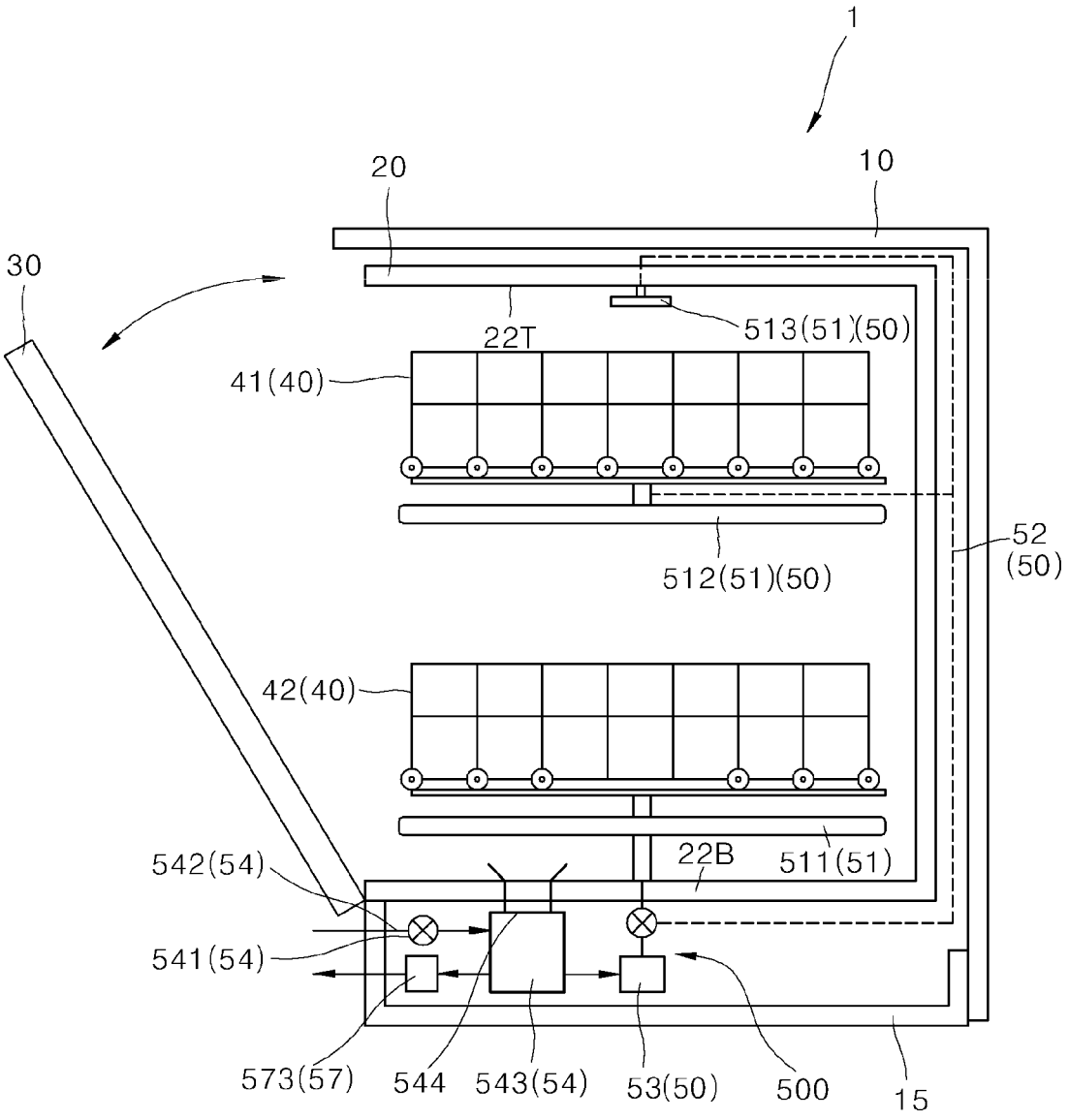
FIG. 2 is a side cross-sectional view illustrating example components of the dish washer.
Figure 3:
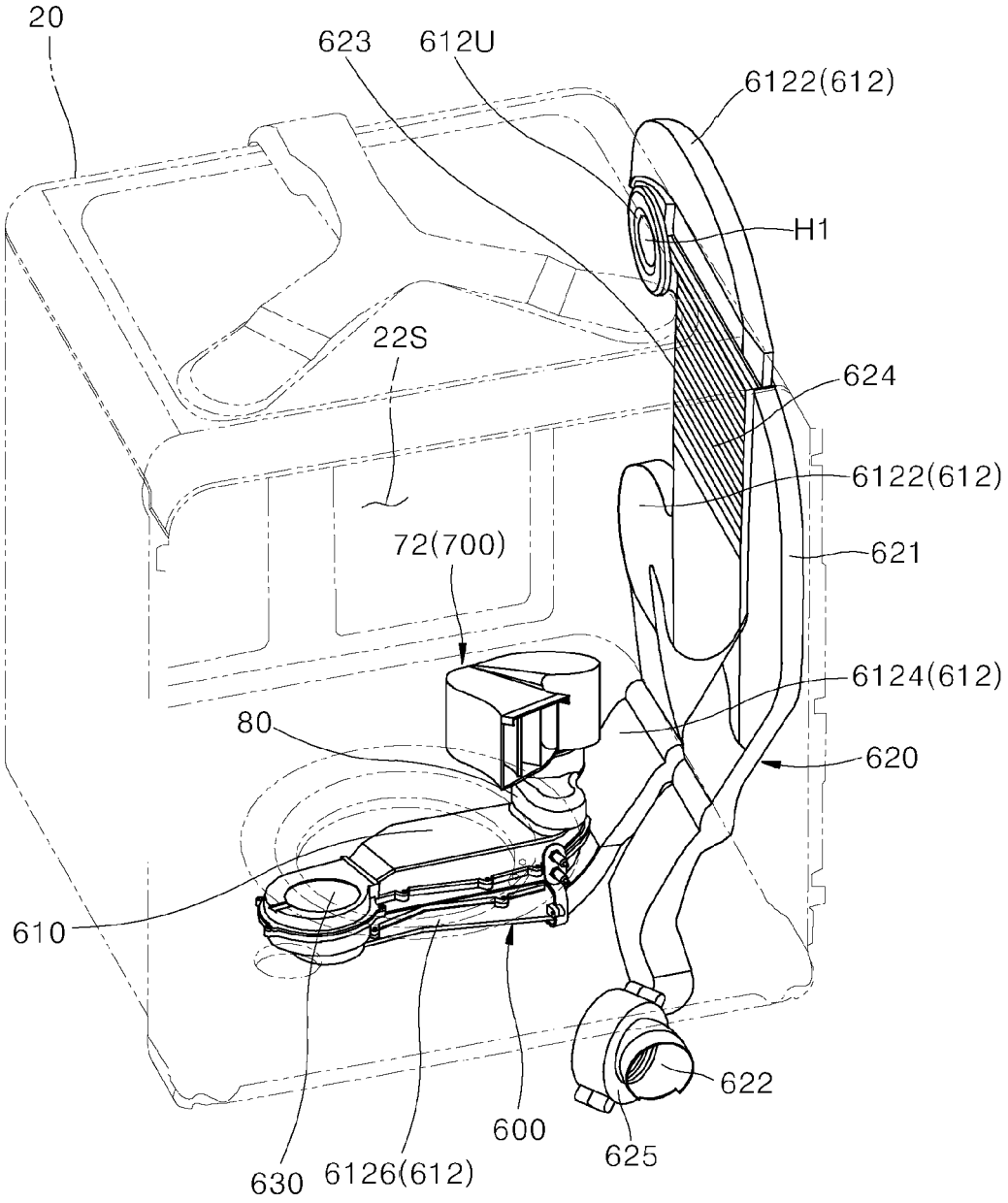
FIG. 3 is a perspective view illustrating example components for drying in the tub.
Figure 4:
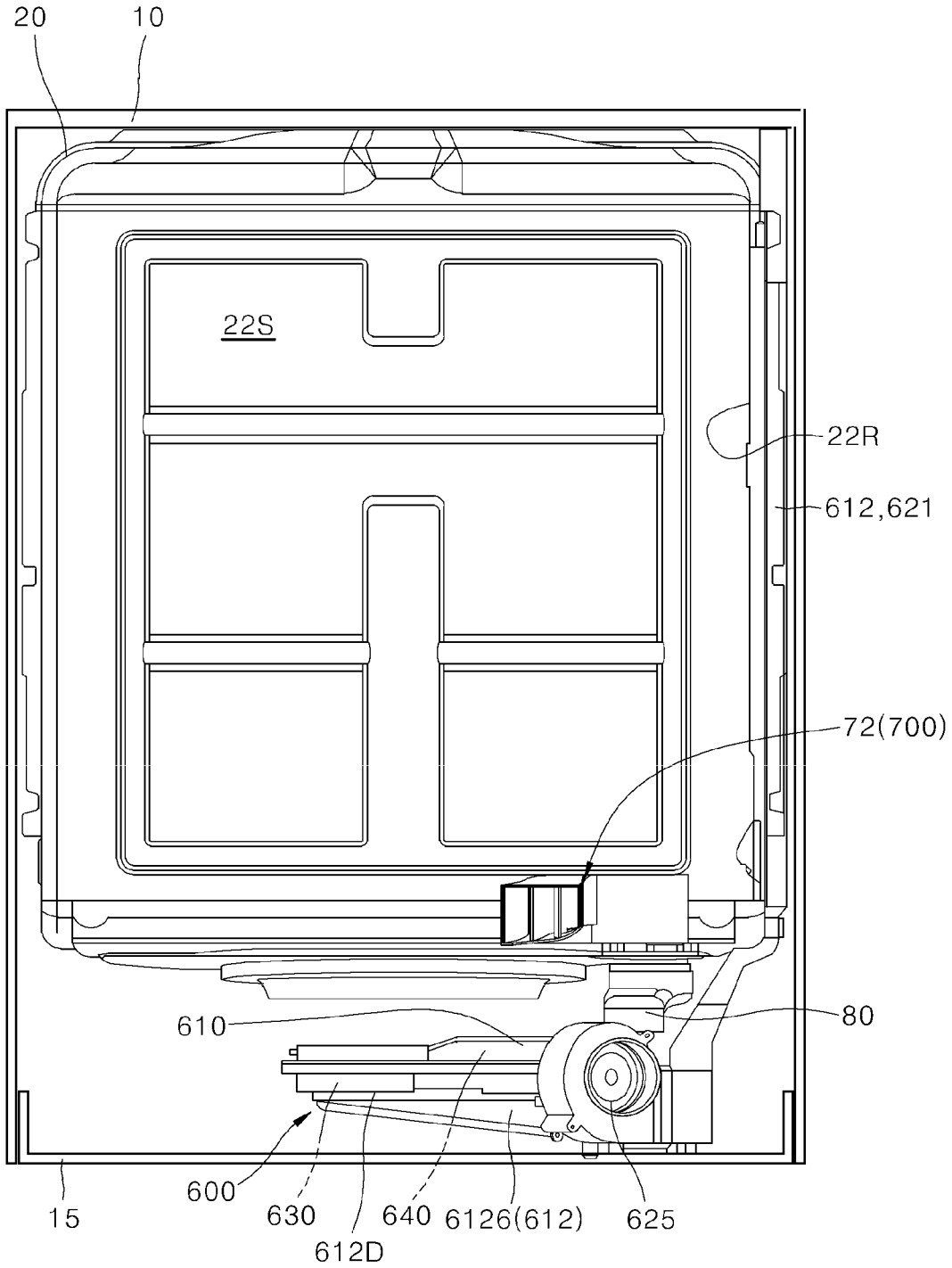
FIG. 4 is a front view illustrating an example of the dish washer without a door and a washing unit.

FIG. 1 is an exploded perspective view illustrating examples of a cabinet 10, a tub 20, and a base 15 of an example of a dish washer 1. FIG. 2 is a side cross-sectional view illustrating the dish washer 1 and example components relating to washing. FIG. 3 is a perspective view illustrating example components relating to drying that are installed in the tub 20. FIG. 4 is a front view illustrating the dish washer 1 when viewed in a state in which a door 30 and a washing unit 500 are omitted.

In some implementations, the dish washer 1 can have a substantially rectangular parallelepiped shape. In some examples, the dish washer 1 can include the cabinet 10, the tub 20, the door 30, the base 15, the washing unit 500, and a drying unit 600.

The cabinet 10 can be a housing constituting exteriors of an upper surface, a left surface, a right surface, and a rear surface of the dish washer 1. The cabinet 10 can be provided by performing a press process on one or more metal plate members.

The base 15 is coupled to a lower end of the cabinet 10 to define a lower surface of the dish washer 1. When the dish washer 1 is installed at a desired place, the base 15 is placed on a floor. The base 15 can be made of, for example, a synthetic resin.

In some examples, the tub 20 can have a rectangular parallelepiped box shape which is open in the forward direction. The tub 20 is fixedly accommodated in the cabinet 10. The tub 20 can be provided by performing a press process on a metal plate member. An inner space defined by the tub 20 constitutes a washing space 22S.

The washing space 22S is opened or closed by the door 30 installed in front of the tub 20. The door 30 can be installed as a pull-down type to be rotatably opened or closed about a horizontal rotary shaft provided in a lower portion thereof.

The washing space 22S accommodates racks 40 capable of holding dishes. In some implementations, a structure in which two stages, that is, an upper rack 41 and a lower rack 42, are installed is illustrated. The racks 40 include wheels for facilitating withdrawal and input in the front-rear direction.

In some implementations, the washing unit 500 can include a water supply device 54, a spray device 50, and a drain unit 57.

The water supply device 54 includes a water supply path 542, a water supply valve 541 provided on the water supply path 542, and a sump 543 which collects supplied water. The water supply path 542 can be connected to a tap. The water supply device 54 controls the water supply valve 541 to be opened or closed to supply a desired amount of water into the dish washer 1. The water supplied through the water supply valve 541 and the water supply path 542 can be stored in the sump 543. The sump 543 is installed under the tub 20. A sump hole 23 is provided in a bottom member 22B of the tub 20, and the sump 543 is installed in the sump hole 23. The sump hole 23 is positioned in a central portion of a front portion of the bottom member 22B.

The spray device 50 includes a washing pump 53, a connection path 52, and spray arms 51. The washing pump 53 supplies the water supplied to the sump 543 through the water supply device 54 to the spray arms 51. The connection path 52 is a path through which the wash water supplied through the washing pump 53 is supplied to the spray arms 51.

A suction part of the washing pump 53 is connected to the sump 543 and suctions the water stored in the sump 543, and a discharge part of the washing pump 53 is connected to the connection path 52 and supplies the high pressure wash water to the connection path 52. The spray arms 51 spray the wash water to the washing space 22S of the tub 20. The spray arms 51 include a lower spray arm 511 provided under a lower rack 42, an upper spray arm 512 provided under an upper rack 41, and a top spray arm 513 provided under a ceiling 22T of the tub 20. The upper spray arm 512 can be installed on the upper rack 41. The spray arms 51 can rotate and spray the wash water.

The wash water sprayed through the spray arms 51 washes the dishes and is collected in the sump 543 installed in the bottom of the tub 20 again. A filter 544 is installed in the sump 543 and filters food waste included in the wash water. The wash water collected in the sump 543 is resupplied to the spray arms 51 by the washing pump 53. When the circulating process of the wash water is repeated, the dishes can be washed and rinsed.

The drain unit 57 includes a drain pump 573 connected to the sump 543. The drain pump 573 discharges the water of the sump 543 to the outside.

Figure 5:
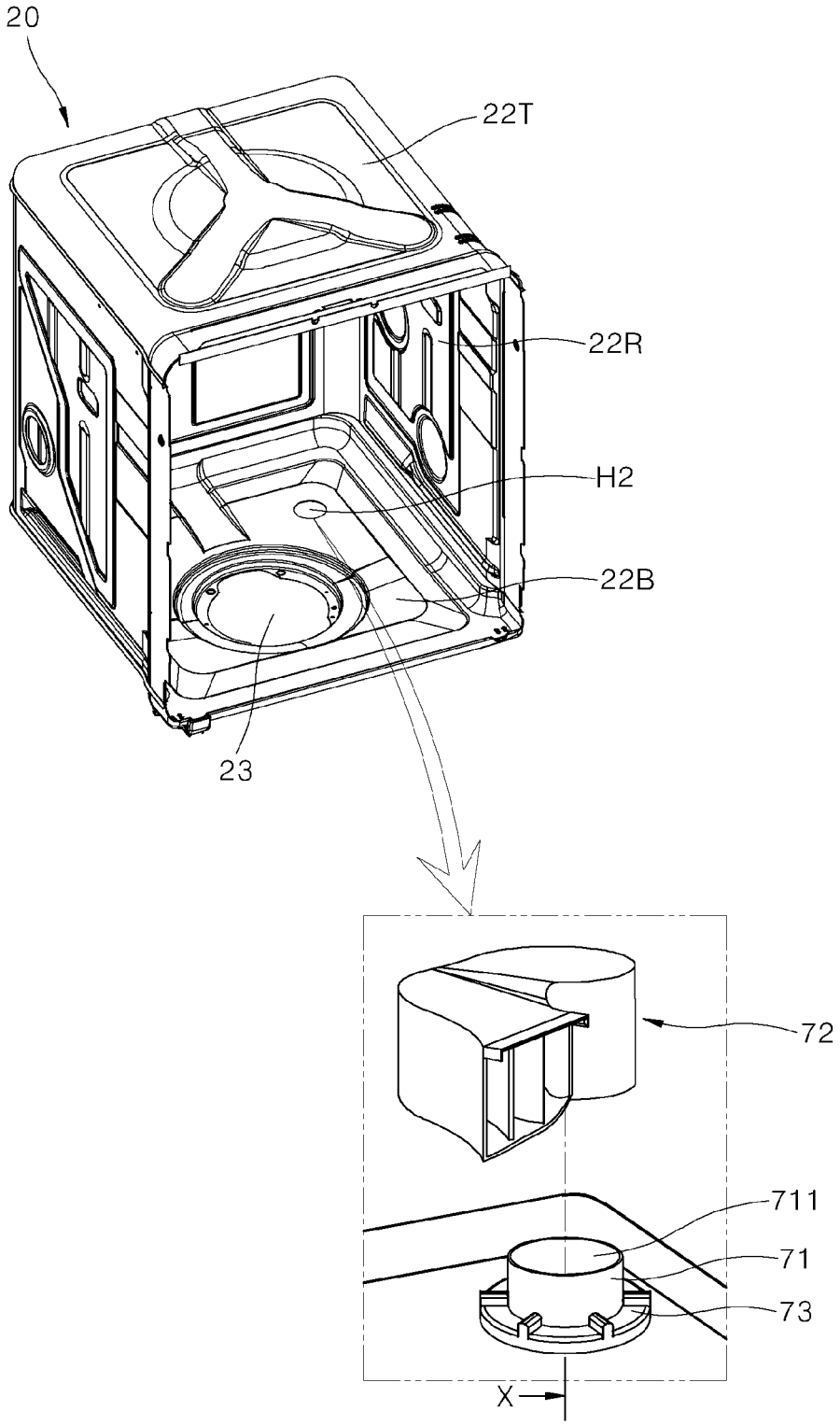
FIG. 5 is a view illustrating an example of an air discharge part installed in a bottom member of the tub.
Figure 6:
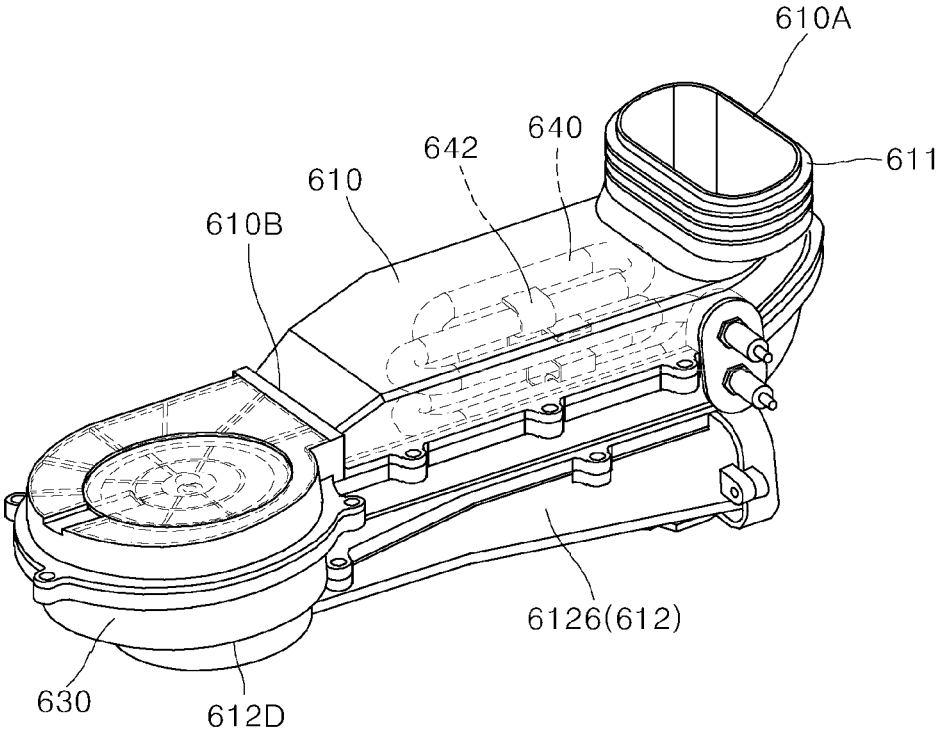
FIG. 6 is a perspective view illustrating an example of a drying unit disposed under the bottom member of the tub.
Figure 7:
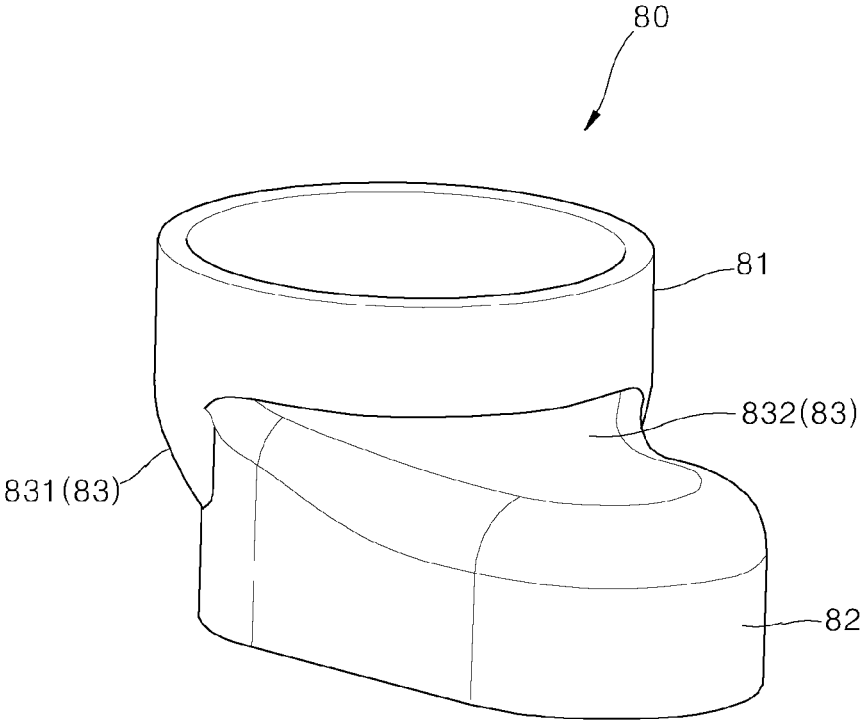
FIG. 7 is a perspective view illustrating an example of a connector which connects the air discharge part and the drying unit.
Figure 8:
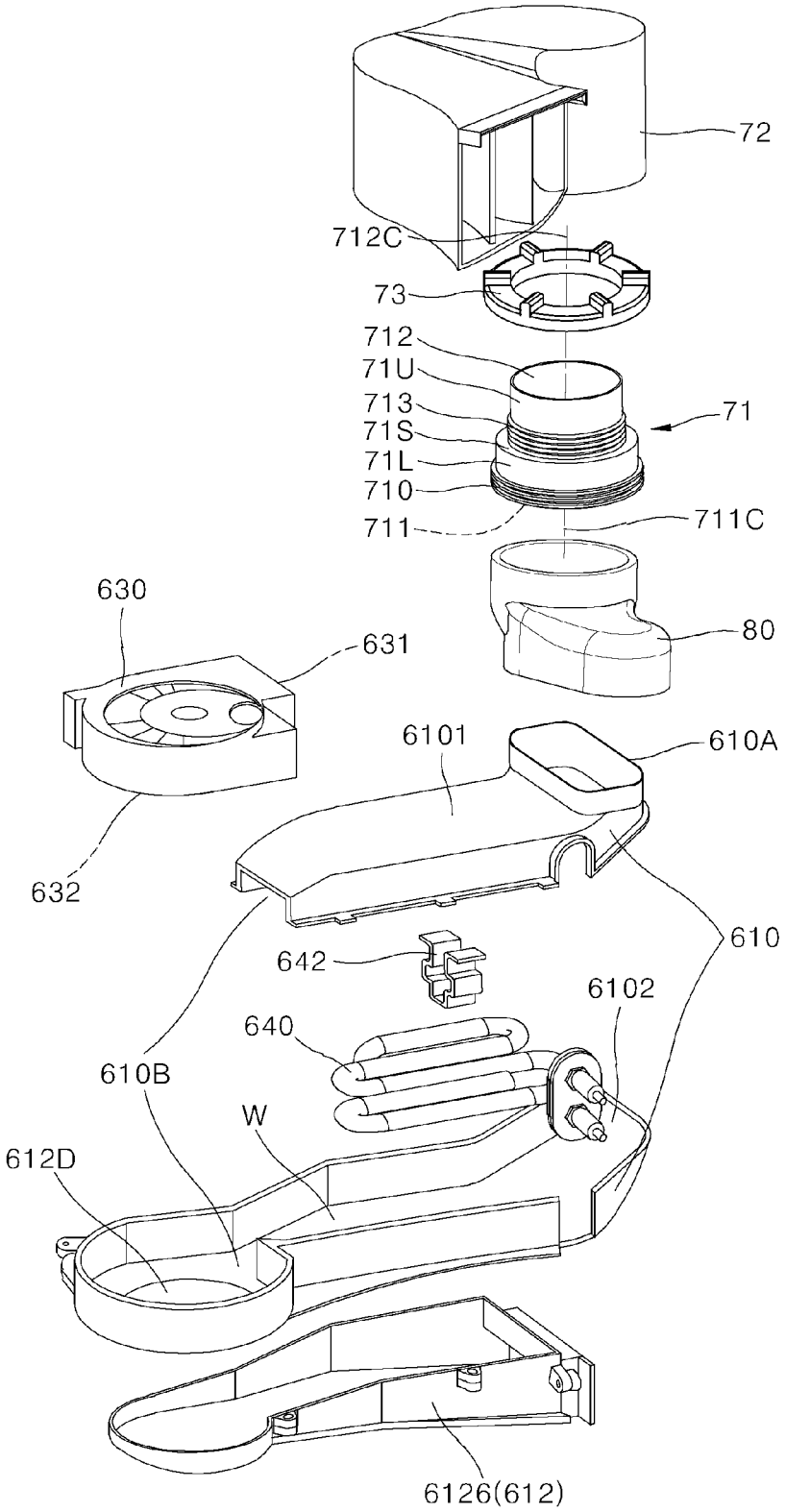
FIG. 8 is an exploded perspective view illustrating the air discharge part, the connector, and the drying unit.
Figure 9:
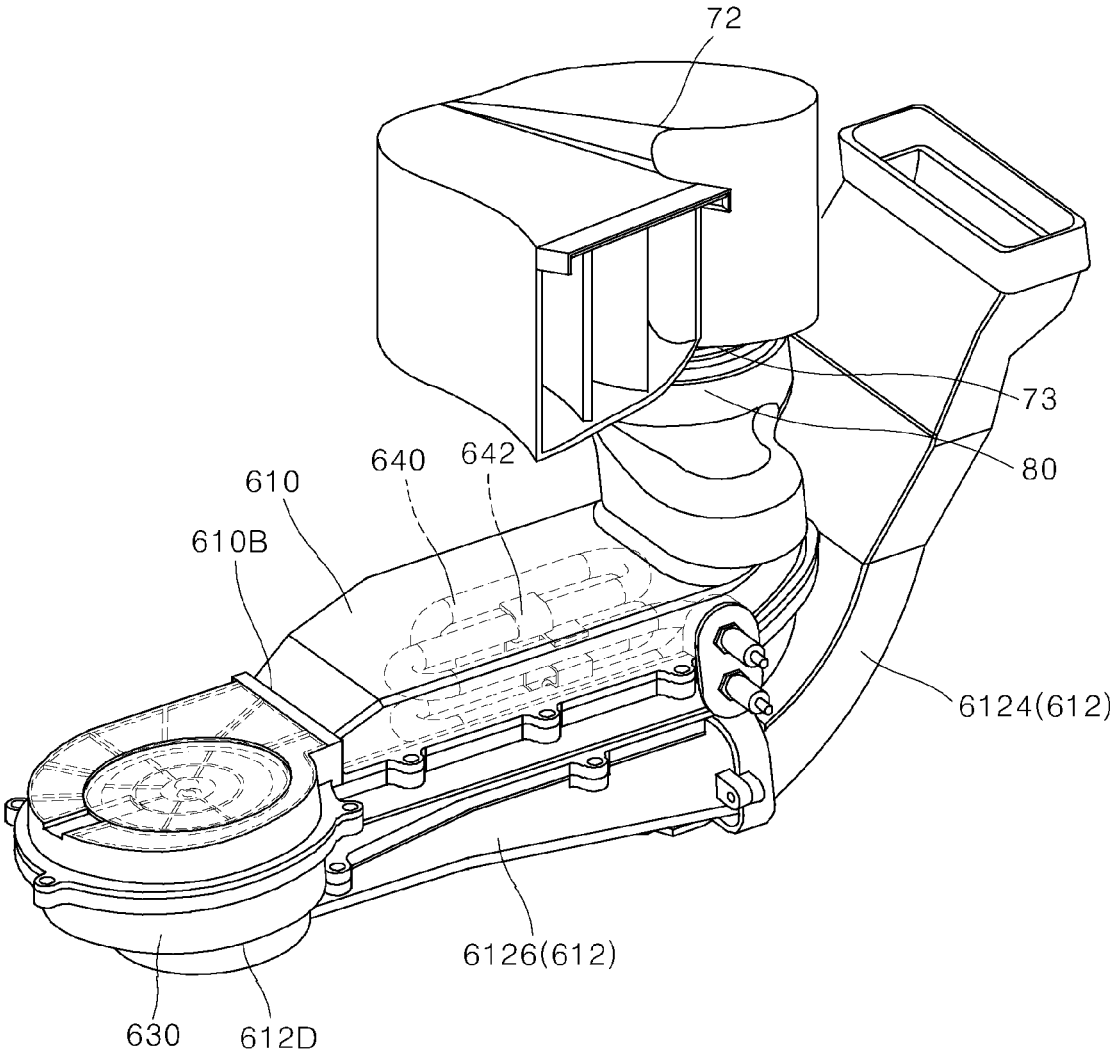
FIG. 9 is a perspective view illustrating an example state in which the air discharge part, the connector, and the drying unit are assembled.
Figure 10:
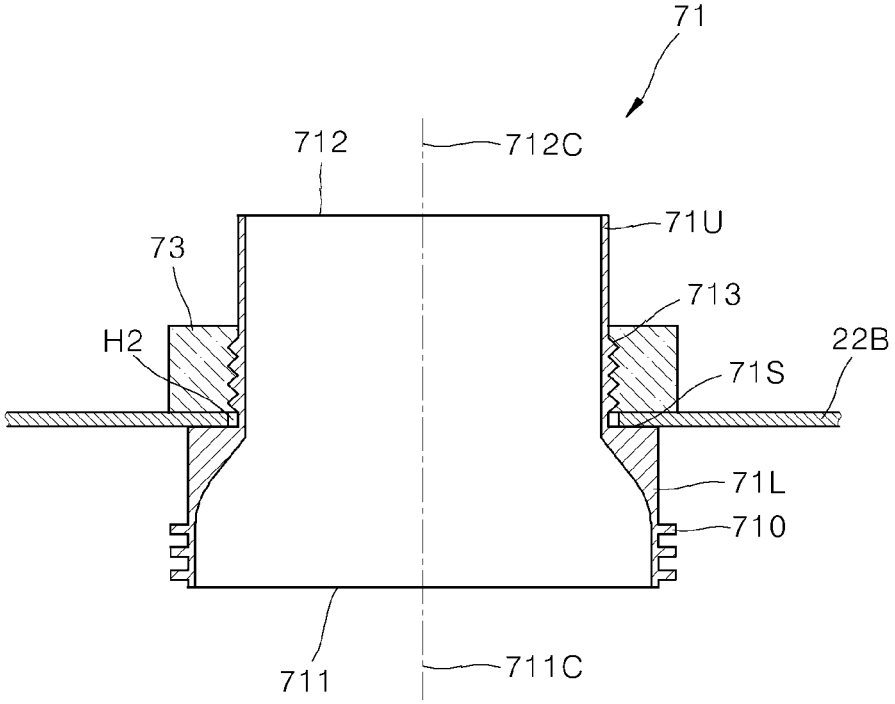
FIG. 10 is a cross-sectional view taken along line X of FIG. 5.

FIG. 5 is a view illustrating an example of an air discharge part 700 that is installed in the bottom member 22B of the tub 20. FIG. 6 is a perspective view illustrating the drying unit 600 disposed under the bottom member 22B of the tub 20. FIG. 7 is a perspective view illustrating an example of a connector 80 which connects the air discharge part 700 and the drying unit 600. FIG. 8 is an exploded perspective view illustrating the air discharge part 700, the connector 80, and the drying unit 600. FIG. 9 is a perspective view illustrating an example state in which the air discharge part 700, the connector 80, and the drying unit 600 are assembled. FIG. 10 is a cross-sectional view taken along line X of FIG. 5.

Referring to FIGS. 3 and 5 to 10, the drying unit 600 of the dish washer 1 includes a drying duct 610. The drying duct 610 of the drying unit 600 is formed by coupling an upper member 6101 and a lower member 6102. The drying duct 610 is disposed under the tub 20. A heater 640, which heats air flowing in the drying duct 610, is fixed by a fixing part 642 in the drying duct 610. The drying duct 610 can be formed of a metal material in order to be prevented from being deformed by heat of the heater 640. For example, the drying duct 610 can be manufactured by performing metal die casting. However, the drying duct 610 can also be manufactured of a synthetic resin having high heat resistance in addition thereto.

The drying duct 610 includes a duct entrance 610B and a duct exit 610A. The duct exit 610A of the drying duct 610 is formed to protrude upward from one end portion of the drying duct 610 in a longitudinal direction. The duct entrance 610B of the drying duct 610 is provided in the other end portion of the drying duct 610 in the longitudinal direction. A flow cross section of the drying duct can have a rectangular shape which is wide in a lateral direction. This shape is a shape which can sufficiently secure a flow cross-sectional area of the drying duct 610 even when a space between the bottom member 22B of the tub 20 and the base 15 is small. The drying duct 610 extends substantially in a horizontal direction.

The duct exit 610A can extend in the third direction. A flow cross section defined by the duct exit 610A of the drying duct 610 can have a track shape having a long axis and a short axis. In some examples, a width direction of the flow cross section of the drying duct 610 is the same as a direction of the long axis of the flow cross section of the duct exit 610A. Accordingly, a flow resistance generated when the air flowing in the drying duct 610 flows to the duct exit 610A can be minimized.

An outlet H2 is provided in the bottom member 22B of the tub 20. The outlet H2 is provided at a right side (one side) of a rear portion of the bottom member 22B. A nozzle 71 is installed to pass through the outlet H2, and a distribution cap 72, which will be described below, covers a portion of the nozzle 71 exposed upward from the bottom member 22B of the tub 20. In addition, a portion of the nozzle 71 exposed downward from the bottom member 22B of the tub 20 is connected to the duct exit 610A provided on a downstream end of the drying duct 610 through the connector 80.

When the duct exit 610A has a track shape, there are no corners angled along an outer circumferential surface of the duct exit 610A. Accordingly, when a duct side connection end portion 82 of the connector 80 surrounds and is press fitted to the outer circumferential surface of the duct exit 610A, the duct side connection end portion 82 of the connector 80 is uniformly deformed in a circumferential direction, and thus there is no worry of excessive deformation of any one portion thereof. Accordingly, the duct side connection end portion 82 of the connector 80, which is formed of a flexible material, for example, a rubber material, may not be damaged or torn.

A discharge part 631 of a fan 630 is connected to the duct entrance 610B provided at an upstream end of the drying duct 610. That is, the fan 630 is disposed upstream from the heater 640 in the drying duct 610 so that air flows toward the downstream end of the drying duct 610, that is, toward the heater 640. Then, heat of the heater 640 can be prevented from influencing the fan 630, and the air heated by the heater 640 can be supplied to the nozzle 71 through the connector 80. The heated air is supplied into the tub 20 through the nozzle 71 and the distribution cap 72. That is, the nozzle 71 and the distribution cap 72 constitute the air discharge part 700 through which the dry air is supplied to the tub 20.

When the drying unit 600 includes the drying duct 610, the heater 640, the fan 630, the connector 80, the nozzle 71, and the distribution cap 72 as described above, the drying unit 600 suctions external air through a suction part 632 of the fan 630, the external air is heated by the heater, the heated air is supplied into the tub 20 to dry the dish, and the air which has dried the dish can be naturally discharged in an open pathway manner.

In addition, the drying unit 600 can be used in a closed circulation manner. For example, the drying unit 600 further includes a condensing duct 612 which returns air in the tub 20 toward the drying duct 610.

Referring to FIGS. 3 and 4, an inlet H1 can be provided in a rear upper portion of one sidewall 22R which defines a right wall of the tub 20. The inlet H1 is provided to pass through the one sidewall 22R so that the inner space and an outer space of the tub 20 communicate with each other. The condensing duct 612 is installed on an outer surface of the one sidewall 22R. An upstream end 612U of the condensing duct 612 is connected to the inlet H1, and a downstream end 612D of the condensing duct 612 is connected to the suction part 632 of the fan 630 to be finally connected to the upstream end 612U of the drying duct 610.

In some implementations, the condensing duct 612 is illustrated as a structure divided into a first condensing duct 6122, a second condensing duct 6124, and a third condensing duct 6126. For example, the first condensing duct 6122 is disposed between the one sidewall 22R of the tub 20 and the cabinet 10, the third condensing duct 6126 is disposed between the bottom member 22B of the tub 20 and the base 15, and the second condensing duct 6124 is disposed between and connects the first condensing duct 6122 and the third condensing duct 6126.

The condensing duct 612 disposed between the one sidewall 22R of the tub 20 and the cabinet 10 is exposed to an external atmosphere at room temperature through the cabinet 10. Accordingly, hot humid air which has dried the dish in the tub 20 is condensed in the condensing duct 612 and condenses water vapor again. The condensed water can be moved, for example, to the sump 543 and discharged to the outside through the drain pump 573.

The drying unit 600 of a closed circulation type can further include a cold air supply part 620 in order to promote condensation of humid air flowing in the condensing duct 612.

The cold air supply part 620 includes a cooling duct 621 which forcibly moves external air. A suction end portion 622 of the cooling duct 621 can be disposed, for example, at a front side in a space provided under the tub 20 and can open in the forward direction. In addition, a cooling fan 625 can be installed at a corresponding position and can suction air in front of the dish washer 1 and supply the air to the cooling duct 621.

The cooling duct 621 further includes a heat exchanger 624. The cooling duct 621 is in contact with the condensing duct 612 in the heat exchanger 624. While the heat exchanger 624 isolates room temperature air flowing in the cooling duct 621 from hot humid air flowing in the condensing duct 612 to prevent mixing therebetween, the heat exchanger 624 secures a maximum direct contact area between the cooling duct 621 and the condensing duct 612 to promote heat exchange between the air in the cooling duct 621 and the air in the condensing duct 612.

The air, which has passed through the heat exchanger 624, in the cooling duct 621 is discharged to the outside through a discharge end portion 623. In some implementations, the heat exchanger 624 including the discharge end portion 623 is illustrated.

FIGS. 5 and 8 to 10 will be referred. The circular outlet H2 is open at one side of rear of the bottom member 22B of the tub 20. The nozzle 71 has a circular pipe shape which extends vertically, and an outer diameter of an upper portion 71U of the nozzle 71 is smaller than an outer diameter of a lower portion 71L of the nozzle 71. That is, a step 71S at which the outer diameter is changed is provided substantially at a middle portion of the nozzle 71 in a height direction. The outer diameter of the upper portion 71U of the nozzle 71 is smaller than an inner diameter of the outlet H2, and the outer diameter of the lower portion 71L of the nozzle 71 is greater than the inner diameter of the outlet H2. Accordingly, the upper portion of the nozzle 71 can be inserted into the tub 20 through the outlet H2 from under the tub 20.

In a state in which the upper portion 71U of the nozzle 71 is inserted thereinto through the outlet H2, a thread 713 provided on an outer circumference of the nozzle 71 and exposed upward from the bottom member 22B can be screw-coupled to a fastener 73. An outer diameter of the fastener 73 is greater than an outer diameter of the outlet H2. Accordingly, as illustrated in FIG. 5, when the fastener 73 is screw-coupled to the outer circumference of the nozzle 71 on the bottom member 22B, the bottom member 22B is compressed in a state in which the bottom member 22B is interposed between a lower surface of the fastener 73 and the step 71S of the nozzle 71, and thus, the nozzle 71 is fixed to the bottom member 22B of the tub 20. A sealing member for preventing leaking of wash water can be interposed between the fastener 73 and the bottom member 22B.

The nozzle 71 which is fixed by passing through the bottom member 22B of the tub 20 has the pipe shape extending vertically. The nozzle 71 can be divided into the upper portion 71U having a small diameter and the lower portion 71L having a large diameter based on the step 71S. The upper portion 71U of the nozzle 71 includes a second opening 712 which is open upward, and the lower portion 71L of the nozzle 71 includes a first opening 711 which is open downward. The first opening 711 and the second opening 712 can have the same shape. In some implementations, both of the first opening 711 and the second opening 712 are illustrated to have circular cross sections. A flow cross section central axis 711C of the first opening 711 can be the same as a flow cross section central axis 712C of the second opening 712. Accordingly, a flow resistance generated by the nozzle 71 can be minimized.

An inner diameter of the first opening 711 is greater than an inner diameter of the second opening 712. Since air flowing in the nozzle 71 flows from the first opening 711 to the second opening 712, a flow cross-sectional area is reduced, and thus a flow velocity increases. A connecting portion between the upper portion 71U and the lower portion 71L, that is, an inner circumferential surface of a portion of the step 71S, constitutes a gently inclined surface to reduce an air resistance.

The nozzle 71 can be manufactured by molding a synthetic resin. For example, the nozzle 71 can be manufactured by injection molding.

In a state in which the nozzle 71 is fixed to the bottom member 22B as described above, the distribution cap 72 is installed on an upper end of the nozzle 71.

Referring to FIGS. 7 to 9, in some implementations, the connector 80 can be made of a rubber material which is flexible and has a certain degree of stiffness. The rubber material has high heat resistance and low thermal conductivity.

The connector 80 includes the duct side connection end portion 82 coupled to the duct exit 610A. The duct side connection end portion 82 covers the outer circumferential surface of the duct exit 610A and is coupled to the duct exit 610A. An outer circumferential protrusion 611 is provided on the outer circumferential surface of the duct exit 610A in a circumferential direction to seal the outer circumferential surface so as to prevent generation of a gap between an inner circumferential surface of the duct side connection end portion 82 and the outer circumferential surface of the duct exit 610A.

The connector 80 includes a nozzle side connection end portion 81 connected to a lower end portion of the nozzle 71. An outer circumferential protrusion 710 is provided on an outer circumferential surface of the lower portion 71L of the nozzle 71 in a circumferential direction to seal the outer circumferential surface so as to prevent generation of a gap between an inner circumferential surface of the nozzle side connection end portion 81 and the outer circumferential surface of the lower portion 71L of the nozzle 71.

Figure 11:
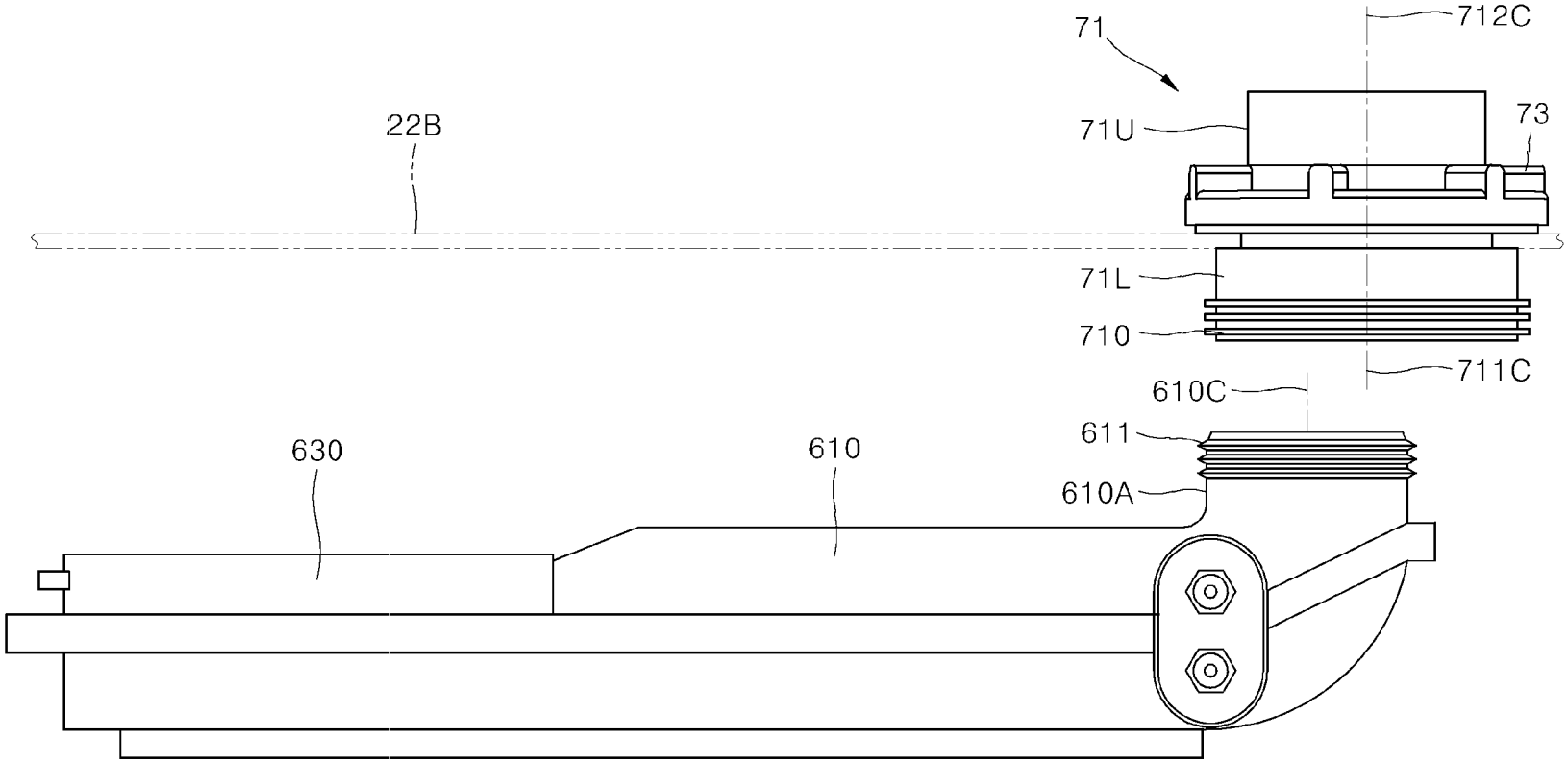
FIG. 11 is a front view illustrating examples of a nozzle and a drying duct without the connector.
Figure 12:
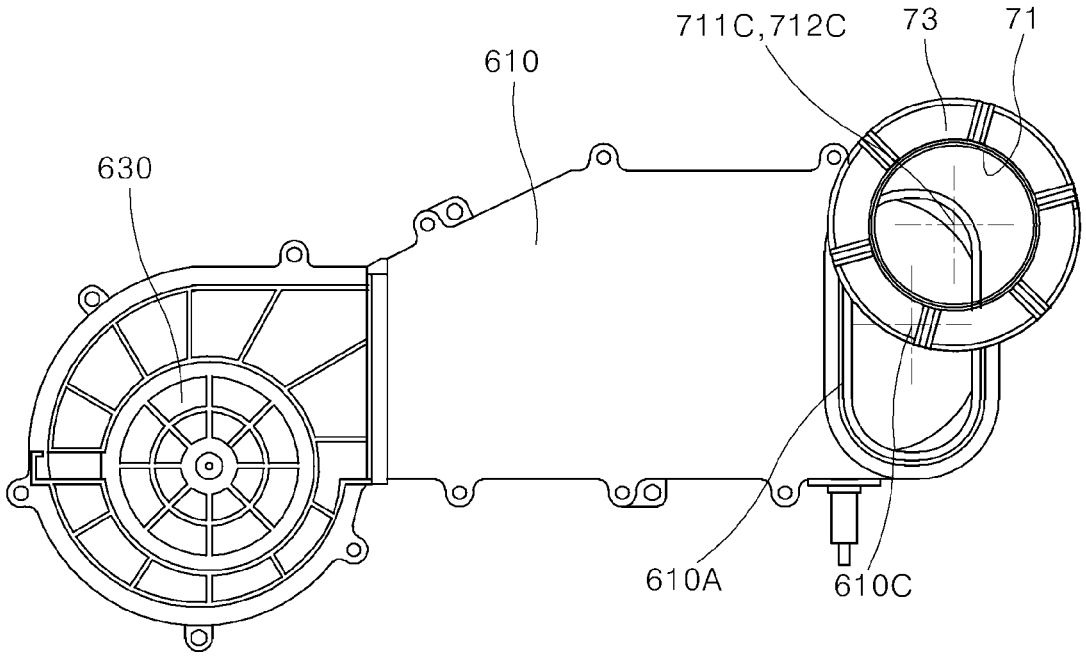
FIG. 12 is a plan view illustrating an example state in which the bottom member is omitted in FIG. 11.
Figure 13:
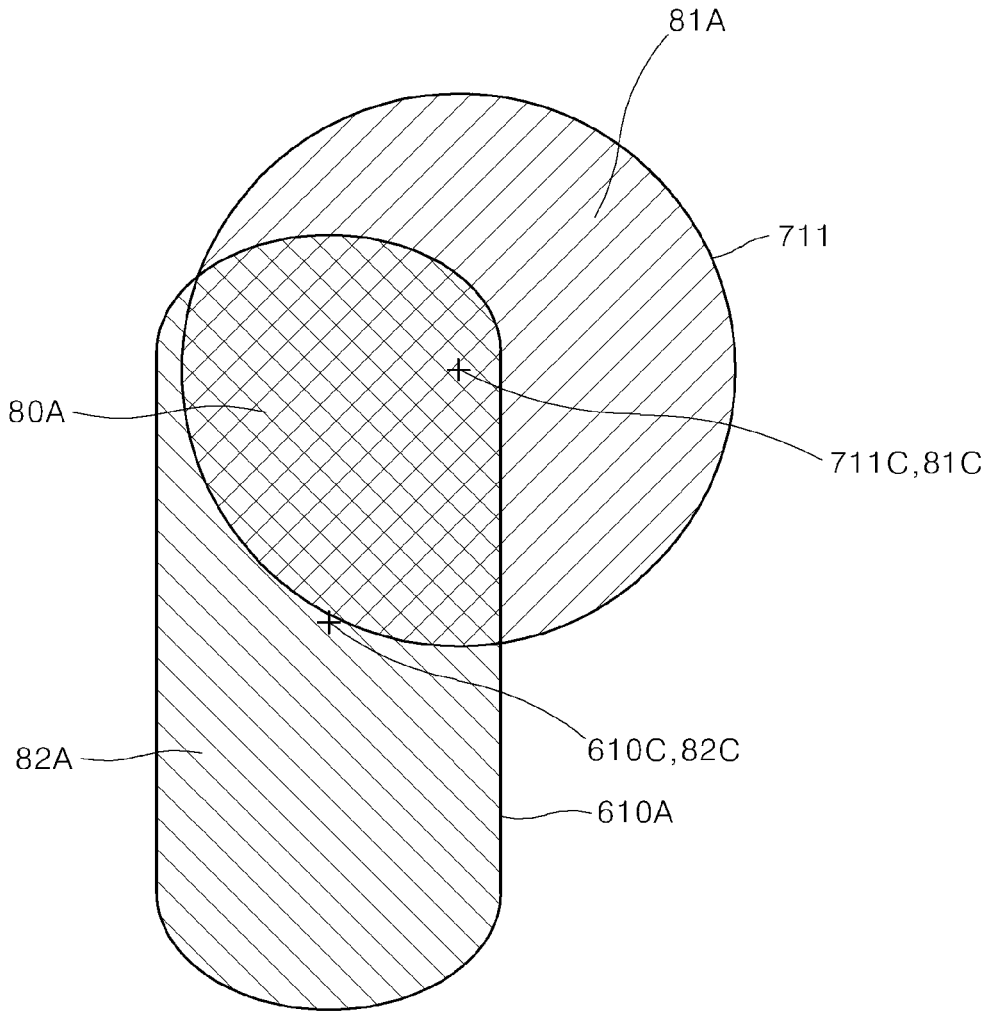
FIG. 13 is a plan view illustrating an example of an overlapping state of a flow cross section of a first opening and a flow cross section of a duct exit of the drying duct.
Figure 14:
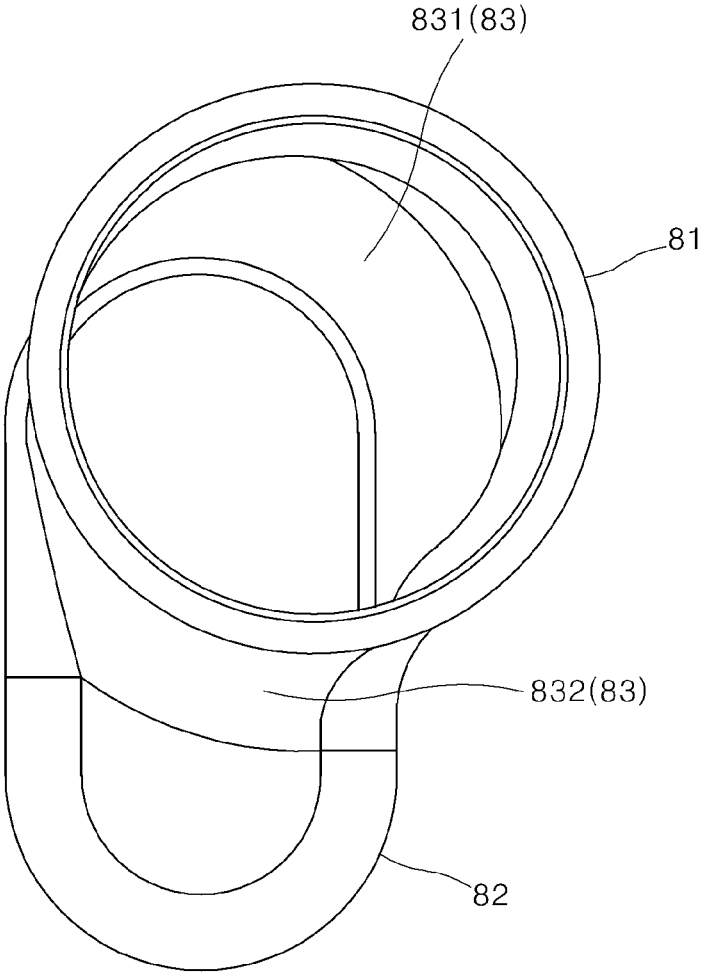
FIGS. 14 and 15 are a plan view and a side view, respectively, illustrating the connector.
Figure 15:
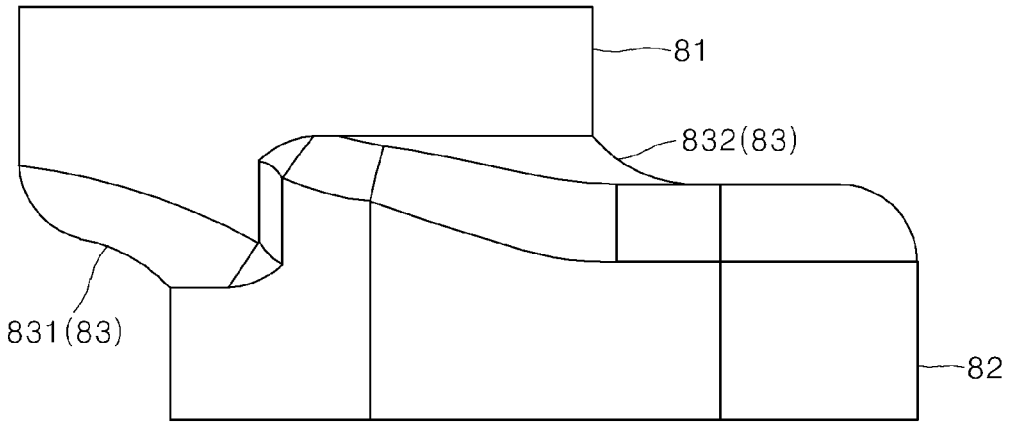
Figure 16:
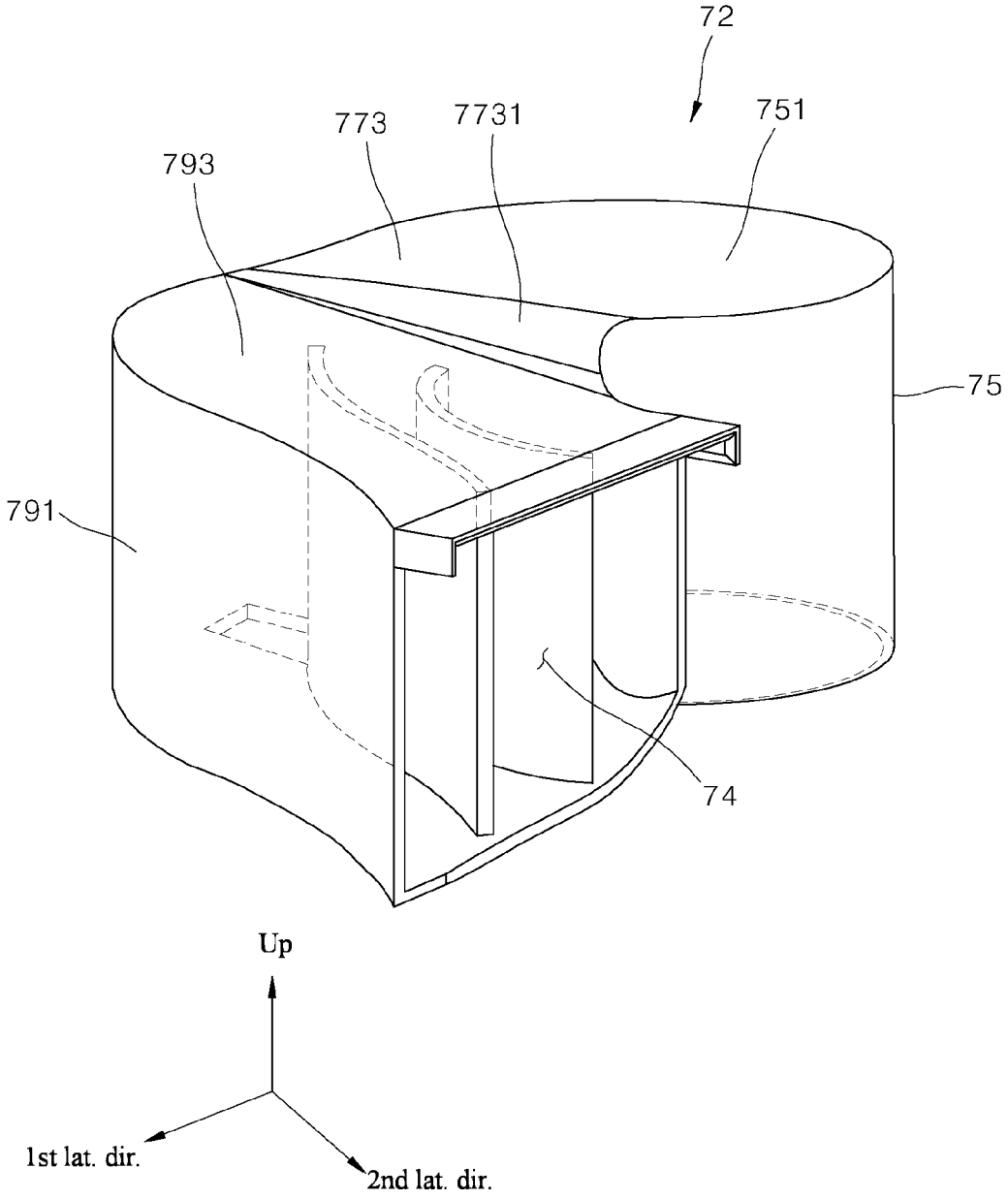
FIG. 16 is a perspective view illustrating an example of a distribution cap.
Figure 17:
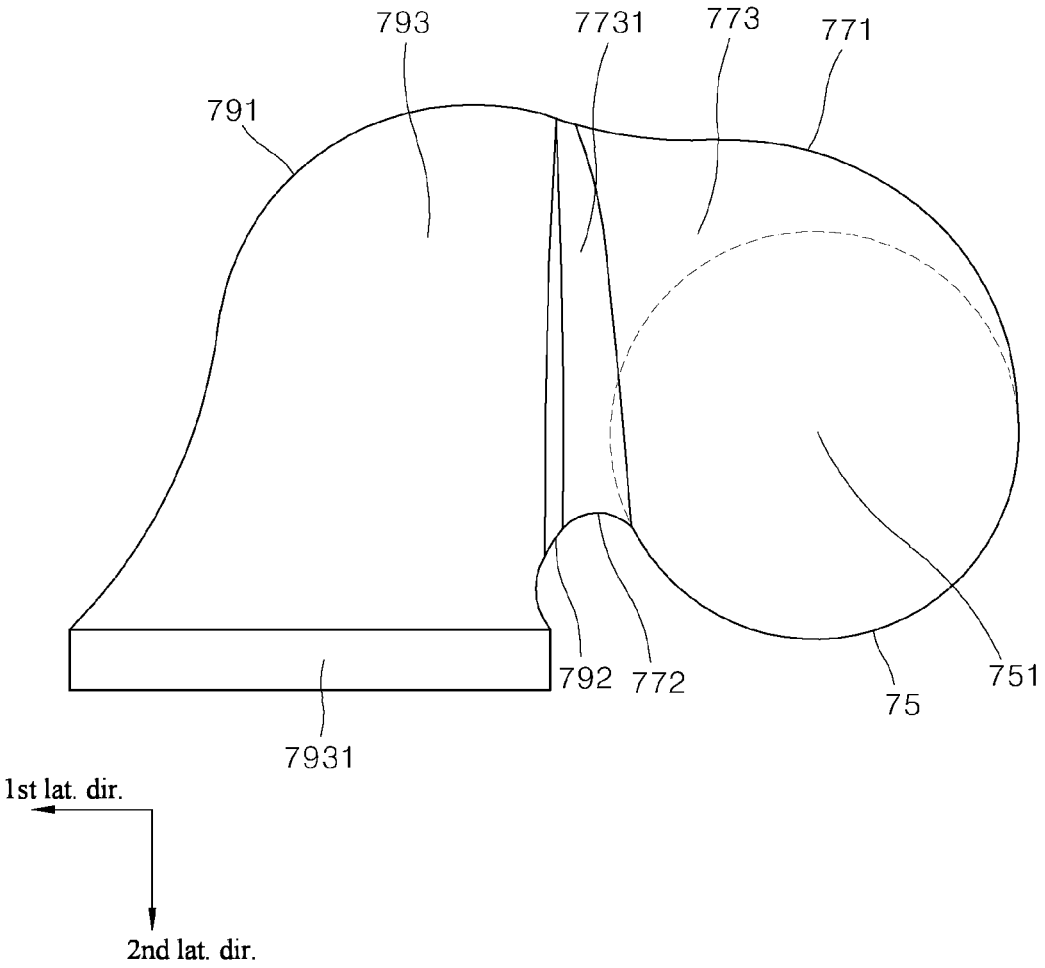
FIG. 17 is a plan view illustrating the distribution cap.
Figure 18:
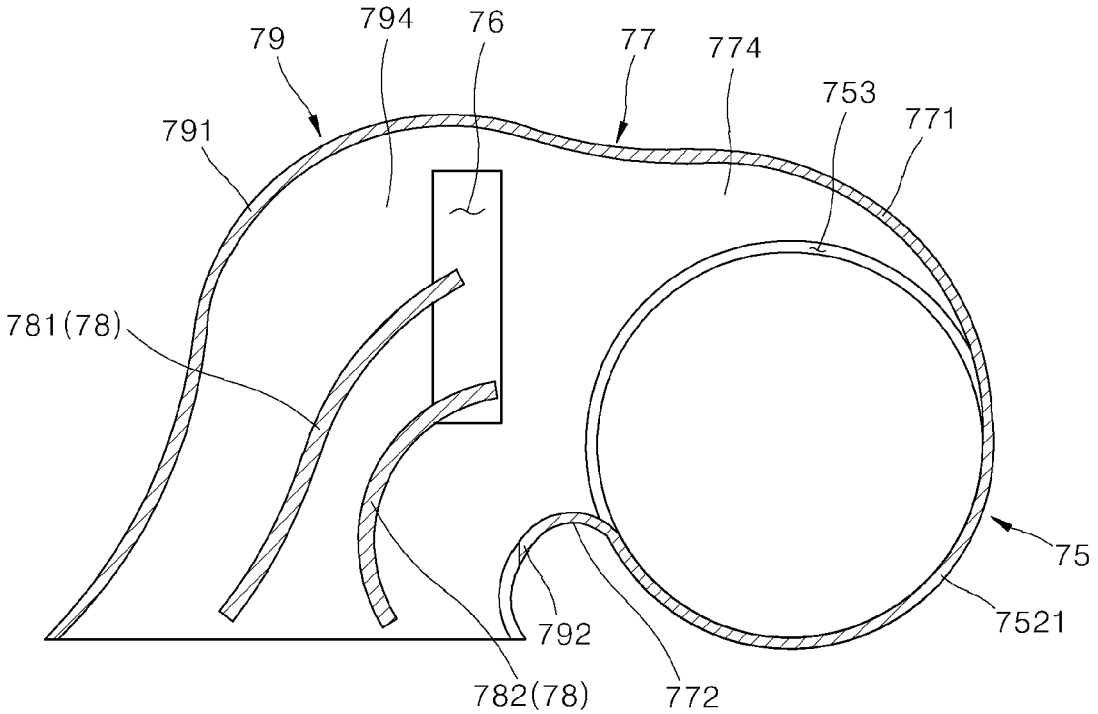
FIG. 18 is a perspective plan view illustrating an example of an inner portion of the distribution cap.

FIG. 11 is a front view illustrating the nozzle 71 and drying duct 610 in a state in which the connector is omitted. FIG. 12 is a plan view illustrating a state in which the bottom member 22B is omitted in FIG. 11. FIG. 13 is a plan view illustrating an overlapping state of a flow cross section of the first opening 711 and the flow cross section of the duct exit 610A of the drying duct 610. FIGS. 14 and 15 are a plan view and a side view illustrating the connector 80.

Referring to FIG. 11, an upper end of the duct exit 610A is disposed at a lower level than a lower end of the nozzle 71. This is a structure capable of minimizing a change in a direction of an air flow path from the duct exit 610A to the nozzle 71. For example, when a level of the upper end of the duct exit 610A is higher than the lower end of the nozzle 71, the direction of air flowing from the duct exit 610A to the nozzle 71 can be changed for the air to flow downward, which can cause an increase in a flow resistance. However, when the upper end of the duct exit 610A is disposed at a lower level than the lower end of the nozzle 71 as described above, the direction of the air flowing from the duct exit 610A to the nozzle 71 can be maintained so that the air may not need to flow downward again.

In some examples, the duct exit 610A of the drying duct 610 and the first opening 711 of the nozzle 71 can be spaced apart from each other in the vertical direction and/or the lateral direction and can be connected through the connector 80.

A central axis 610C of the flow cross section defined by the duct exit 610A extending in the third direction can be parallel to the flow cross section central axis 711C of the first opening 711. In some examples, a flow direction of air flowing upward from the duct exit 610A can be maintained in the first opening 711 without changing.

In some examples, the central axis 610C of the duct exit 610A is disposed to be misaligned with the central axis 711C of the first opening 711. Referring to FIGS. 12 and 13, the central axis 711C of the first opening 711 is disposed to be misaligned with the central axis 610C in a long axis direction of the duct exit 610A and also disposed to be misaligned with the central axis 610C in a short axis direction of the duct exit 610A.

When the duct exit 610A and the first opening 711 are disposed so that centers thereof are misaligned, deformation of the connector 80 connecting the duct exit 610A and the first opening 711 can be easily induced even when the duct exit 610A is relatively moved with respect to the first opening 711 in the third direction by an external force such as an impact applied to the dish washer.

For example, when the duct exit 610A has a circular shape, the first opening 711 has a circular shape having the same size as that of the duct exit 610A, and the center of the duct exit 610A and the center of the first opening 711 are aligned with each other in the third direction, the connector 80 can be formed in a simple circular pipe shape. In this case, even when the connector 80 is formed of a flexible material such as rubber, relative movement of the duct exit 610A with respect to the first opening 711 can be considerably transmitted to the first opening 711 through the connector 80. This causes a result of the impact being transmitted to the nozzle 71 even when the connector 80 is formed of the flexible material. Accordingly, it can be considered that the connector 80 is formed in a corrugated pipe form which easily stretches in a longitudinal direction. However, the corrugated pipe shape has a disadvantage in that the flow resistance increases considerably.

In some cases, where the center of the duct exit 610A and the center of the first opening 711 are misaligned, and the connector 80 has a smooth pipe shape connecting the duct exit 610A and the first opening 711, the connector 80 may deform when the duct exit 610A moves upward toward the first opening 711, or the duct exit 610A moves downward away from the first opening 711. That is, since the connector 80 secures a certain degree of stiffness in the third direction but is very flexible in the lateral direction, even when the duct exit 610A relatively moves with respect to the first opening 711, the connector 80 may be deformed and absorb the impact.

For instance, a center of the flow cross section of the duct exit 610A and a center of the flow cross section of the first opening 711 are misaligned with each other when an extension line of a central axis of the flow cross section of the duct exit 610A is offset from an extension line of a central axis of the flow cross section of the first opening 711.

That is, even when the extension line of the central axis of the flow cross section of the duct exit 610A and the extension line of the central axis of the flow cross section of the first opening 711 meet at any one point, and when the extension line of the central axis of the flow cross section of the duct exit 610A is not the same as the extension line of the central axis of the flow cross section of the first opening 711, smooth deformation of the connector 80 can be expected as described above.

For example, the center of the flow cross section of the duct exit 610A and the center of the flow cross section of the first opening 711 are misaligned with each other when the extension line of the central axis of the flow cross section of the duct exit and the extension line of the central axis of the flow cross section of the first opening do not meet each other. That is, regardless of whether two extension lines are parallel, when two extension lines do not meet each other, the smooth deformation of the connector 80 can be expected as described above.

In some examples, even when the center of the duct exit 610A and the center of the first opening 711 are the same, when the shape of the duct exit 610A is different from the shape of the first opening 711, even when the connector 80 connecting the duct exit 610A and the first opening 711 is formed in the smooth pipe shape, a cross-sectional shape of the connector 80 extending in the third direction can be formed to be changed in the longitudinal direction. Since this shape can be flexibly changed in a certain degree in the lateral direction, the flow resistance can be minimized, and even when the duct exit 610A is relatively moved with respect to the first opening 711, the connector 80 can be deformed to absorb the impact.

In addition, even when the center of the duct exit 610A and the center of the first opening 711 are the same, and the shapes thereof correspond to each other, when a size of the duct exit 610A and a size of the first opening 711 are different from each other, even when the connector 80 connecting the duct exit 610A and the first opening 711 is formed in the smooth pipe shape, a cross-sectional area of the connector 80 extending in the third direction can be formed to be changed in the longitudinal direction. For example, when the duct exit 610A has a large circle, and the first opening 711 has a small circle, the connector 80 can have a shape like a cone. Since the shape can be flexibly deformed by a certain degree in the lateral direction unlike a circular pillar shape, the flow resistance can be minimized, and even when the duct exit 610A moves relatively with respect to the first opening 711, the connector 80 can be deformed to absorb the impact.

Accordingly, as in some implementations, when the shape of the duct exit 610A and the shape of the first opening 711 are different from each other, and the center of the flow cross section of the duct exit 610A and the center of the flow cross section of the first opening 711 are disposed to be misaligned with each other, even when the connector 80 connecting the duct exit 610A and the first opening 711 is formed in the smooth pipe shape, the connector 80 can be more easily and elastically deformed.

That is, according to conditions of the shapes, positions, and/or sizes of the duct exit 610A and the first opening 711, an inner surface of the connector can be formed in a smooth and flat or soft curved shape to reduce an air resistance and to also easily induce elastic deformation of the connector 80.

In some implementations, the flow cross-sectional area of the first opening 711 can be greater than a flow cross-sectional area of the duct exit 610A. Accordingly, since the flow cross-sectional area of the connector 80 can be formed to increase in the longitudinal direction, a flow loss, which can be generated when the shape of the flow cross section is changed, can be minimized.

Referring to FIGS. 7 and 13 to 15, the connector 80 has the pipe shape. An upper end portion of the pipe shape of the connector 80 surrounds an outer circumference of the lower portion 71L of the nozzle 71 and constitutes the nozzle side connection end portion 81 connected to the nozzle 71. A shape of the nozzle side connection end portion 81 can be a circular pipe shape.

A lower end portion of the pipe shape of the connector 80 surrounds an outer circumference of the duct exit 610A of the drying duct 610 and constitutes the duct side connection end portion 82 connected to the drying duct 610. A shape of the duct side connection end portion 82 can be a track type pipe shape.

In some examples, a cross-sectional shape of the nozzle side connection end portion 81 can be different from a cross-sectional shape of the duct side connection end portion 82 to correspond to a difference in shape between the flow cross section of the duct exit 610A and the first opening 711.

In some examples, a central axis 81C of the nozzle side connection end portion 81 and a central axis 82C of the duct side connection end portion 82 may not overlap with each other and correspond to a difference in central axes of the flow cross section of the duct exit 610A and the flow cross section of the first opening 711.

Referring to FIG. 13, when viewed from the vertical direction (the third direction), an overlap region 80A, in which an inner portion of the nozzle side connection end portion 81 overlaps an inner portion of the duct side connection end portion 82, is provided. When the overlap region 80A is present, a flow resistance generated due to the connector 80 in which a flow direction of air is changed in the longitudinal direction thereof can be minimized.

The inner portion of the nozzle side connection end portion 81 can include the overlap region 80A and a nozzle side unique region 81A which is not included in the overlap region. Similarly, the inner portion of the duct side connection end portion 82 can include the overlap region 80A and a duct side unique region 82A which is not included in the overlap region.

In the connector 80, a flow guide part 83 is disposed between the nozzle side connection end portion 81 and the duct side connection end portion 82. The flow guide part 83 can induce a change of the air flow direction because a central axis of the duct side connection end portion 82 may not match a central axis of the nozzle side connection end portion 81.

A first inclined guide surface 831 can be provided in a portion of the flow guide part 83 extending from the overlap region 80A of the duct side connection end portion 82 to the nozzle side unique region 81A of the nozzle side connection end portion 81. Due to the first inclined guide surface 831, a flow cross section of the connector 80 is expanded from a track shape to a circular shape.

In addition, a second inclined guide surface 832 can be provided in the portion of the flow guide part 83 extending from the duct side unique region 82A of the duct side connection end portion 82 to the overlap region 80A of the nozzle side connection end portion 81. Due to the second inclined guide surface 832, the flow cross section of the connector 80 is reduced from the track shape to the circular shape.

A cross-sectional area increased by the first inclined guide surface 831 is greater than a cross-sectional area decreased by the second inclined guide surface 832. Accordingly, a flow resistance, which can be generated while an air flow direction is changed, can be minimized.

Since the connector 80 is formed of the material, for example, the rubber material, which is flexible and has high heat resistance and low thermal conductivity, the connector 80 can be prevented from being deformed by hot air heated while flowing in the drying duct 610, and heat of the drying duct 610 can also be blocked from being conducted to the nozzle 71. For example, when the drying duct 610 is directly connected to the nozzle 71, the heat of the drying duct 610 is directly conducted to the nozzle 71.

According to a layout of the connector 80 and the nozzle 71 and the drying duct 610 which are connected to the connector 80, in a state in which the drying unit 600 is connected to a lower portion of the tub 20, the connector 80, which is a connecting portion of the tub and the drying unit, can absorb or distribute an impact. In addition, the connector 80 prevents the heat of the drying duct 610 from being transmitted to the nozzle 71. Accordingly, even when the bottom member 22B of the tub 20 is manufactured to be thin, and a weight of the drying unit 600 is heavy, the tub 20 and the drying unit 600 can be prevented from being deformed or damaged, and even in a high temperature environment in the drying unit, durability of the connecting portion between the tub 20 and the drying unit 600 can be secured.

Hereinafter, a detailed structure of the distribution cap will be described with reference to FIGS. 16 to 27.

The distribution cap 72 is coupled to the nozzle 71 in order to prevent wash water from being introduced through the second opening 712 provided in an upper portion of the nozzle 71. In addition, the distribution cap 72 serves to diffusely discharge dry air so that the dry air discharged from the nozzle 71 is uniformly supplied to the washing space 22S in the tub 20.

For example, in the distribution cap 72, a path through which the air is introduced from the nozzle 71 is provided, a shape or guide for uniformly distributing the air from the nozzle 71 is provided, and a discharge opening 74 through which the distributed dry air is discharged is provided.

In some implementations, the second opening 712 of the upper portion 71U of the nozzle 71 has the circular cross-section and is open upward. The distribution cap 72 prevents the wash water from being introduced through the second opening 712 during a process in which the dish washer washes the dish, receives dry air through the second opening 712, and uniformly distributes and discharges the received dry air to the washing space in the tub 20.

The distribution cap 72 sequentially includes a fitting pipe 75, a first bypass pipe 77, a second bypass pipe 79, and the discharge opening 74 in order of a flow direction of air supplied from the nozzle 71.

The discharge opening 74 is open in a second lateral direction perpendicular to a first lateral direction at a position eccentrically moved from the fitting pipe 75 in the first lateral direction. Accordingly, an actual discharge direction of dry air discharged from the discharge opening 74 corresponds to the second lateral direction. In this case, the actual discharge direction means an average direction of the discharged dry air. For example, when dry air is diffusely discharged, the discharge direction can mean a central direction of many directions in which the dry air is discharged.

The fitting pipe 75 can have a pipe shape having a fitting hole 75H which is open downward. The fitting pipe 75 is coupled to the nozzle 71 at the upper portion of the nozzle 71. A sidewall member 752 of the fitting pipe 75 can include a fitting section 7521, which overlaps and is coupled to the nozzle 71, and an upper section 7522 provided above the fitting section 7521. An inner diameter of the fitting section 7521 can correspond to the outer diameter of the upper portion 71U of the nozzle 71. Accordingly, the nozzle 71 can be inserted into the fitting pipe 75. In a state in which the fitting pipe 75 is coupled to the nozzle 71, a section of the fitting pipe 75 extending upward further than the nozzle 71 is the upper section 7522. An inner diameter of the upper section 7522 can be equal to, smaller than, or greater than the inner diameter of the fitting section 7521.

In a state in which the fitting pipe 75 is coupled to the nozzle 71, an open part 753 formed by opening a part of the upper section 7522 of the fitting pipe 75 in a circumferential direction is provided. The open part 753 is directed in a direction opposite to the second lateral direction and directed in the first lateral direction.

A shape of the open part 753 is illustrated substantially as a quadrangular shape curved along a circumference of the fitting pipe 75. The quadrangular shape includes an upper side, a lower side, and both sides. The upper side is horizontal, and the lower side is inclined downward in the first lateral direction. In addition, the both sides extend vertically. However, the shape of the open part 753 is not necessarily limited thereto.

An upper end portion of the fitting pipe 75 is blocked by an upper end member 751. Accordingly, dry air discharged from the nozzle 71 does not flow upward any more from the upper section 7522, and a flow direction of the dry air is changed to the lateral direction by the open part 753.

In some implementations, the upper end member 751 is illustrated as a flat shape but this is only an example, and, for example, any streamlined shape capable of guiding a change in flow toward the open part 753 can be applied.

The first bypass pipe 77 is connected to the open part 753, extends in the direction opposite to the second lateral direction, and also extends in the first lateral direction.

The first bypass pipe 77 includes a first upper surface 773 connected to the upper side of the open part 753, a first bottom surface 774 connected to the lower side of the open part 753, and a first outer circumferential surface 771 and a first inner circumferential surface 772 connected to the both sides of the open part 753.

A flow cross section formed by an extension direction of the first bypass pipe 77 can have a substantially quadrangular shape.

The first upper surface 773 can have a horizontal flat shape.

The first outer circumferential surface 771 can have a curved shape perpendicular to the first upper surface 773.

The first outer circumferential surface 771 can have a distance 1 (see FIG. 19) from a center of the fitting pipe 75 increasing gradually in a direction away from a connecting portion with the fitting pipe 75. The first outer circumferential surface 771 can be divided into a first convex section k1, a first inflection section k2, and a first concave section k3 in order of an increase in a distance from the connecting portion with the fitting pipe 75.

Figure 19:
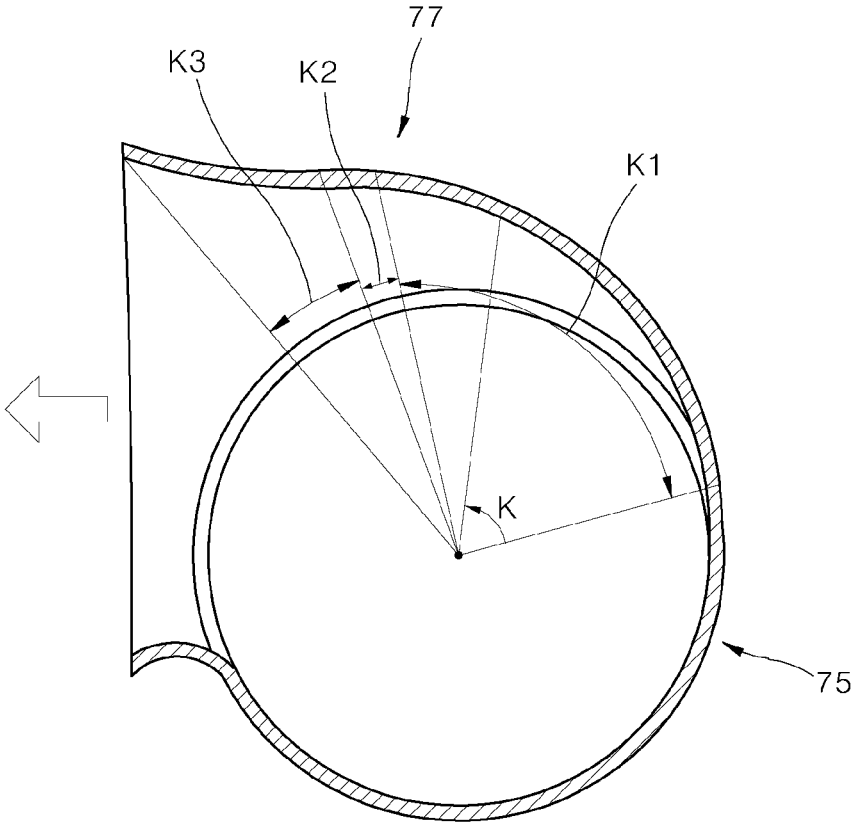
FIG. 19 is a view illustrating example portions of a fitting pipe and a first bypass pipe in FIG. 18.

The first convex section k1 is a section having a convex curved surface. Referring to FIG. 19, in this section, it can be expressed as $dl/dk>0$ and $d^2l/dk^2<0$. This shape allows a flow resistance to be minimized and allows a flow direction of dry air flowing from the fitting pipe 75 toward the first bypass pipe 77 to be changed to the first lateral direction quickly.

The first inflection section k2 is a section having a flat surface. In this section, it can be expressed as $dl/dk>0$ and $d^2l/dk^2=0$. In this section, a flow of the dry air of which the direction is changed to the first lateral direction is stabilized. This section can be short or may not be present.

The first concave section k3 is a section having a concave surface. In this section, it can be expressed as $dl/dk>0$ and $d^2l/dk^2>0$. This shape corresponds to a section in which a flow cross section of the air directed in the first lateral direction is expanded, and thus, it is advantageous for more widely diffusing dry air.

The first inner circumferential surface 772 has a curved surface formed by changing a curve direction of the fitting pipe 75 connected to the first inner circumferential surface 772. That is, the first inner circumferential surface 772 also becomes a section in which a flow cross section of air is expanded.

The first bottom surface 774 can be a surface inclined downward in the first lateral direction. The first bottom surface 774 can be a flat surface having a constant inclination angle m. Unlike the first upper surface 773 which is horizontally flat, since the first bottom surface 774 is inclined downward in the first lateral direction, a flow cross-sectional area of dry air increases gradually, and wash water splashed inside during the dishwashing process is induced to flow out due to a weight thereof. The constant inclination angle m of the first bottom surface 774 induces the wash water to flow smoothly.

In some examples, a transition section 7731 can be present at an edge of the first upper surface 773 adjacent to the second bypass pipe 79. The transition section 7731 can be referred to as a connection section for connecting the first upper surface 773 and the second bypass pipe 79 in a streamlined shape because a second upper surface 793 of the second bypass pipe 79, which will be described below, is inclined in the second lateral direction.

A flow of dry air in an end portion of the first bypass pipe 77 can be directed in the first lateral direction as illustrated in FIG. 19. In addition, a flow cross section of the end portion of the first bypass pipe 77 can be directed in the first lateral direction.

The second bypass pipe 79 is connected to the end portion of the first bypass pipe 77, extends in the first lateral direction, and also extends in the second lateral direction.

The second bypass pipe 79 includes the second upper surface connected to an end portion of the first upper surface 773 of the first bypass pipe 77 (to be precise, an end portion of the transition section 7731), a second bottom surface 794 connected to an end portion of the first bottom surface 774 of the first bypass pipe 77, a second outer circumferential surface 791 connected to the first outer circumferential surface 771 of the first bypass pipe 77, and a second inner circumferential surface 792 connected to the first inner circumferential surface 772 of the first bypass pipe 77.

A flow cross section formed in an extension direction of the second bypass pipe 79 can also have a substantially quadrangular shape.

The second upper surface 793 can have a shape that is inclined downward in the second lateral direction, that is, a discharge direction. The second upper surface 793 can have a flat shape having a predetermined inclination angle n1 in the second lateral direction.

An upper end portion of the second outer circumferential surface 791 can be connected to an edge of the second upper surface 793, and the second outer circumferential surface 791 can have a curved shape perpendicular to a horizontal surface.

The second outer circumferential surface 791 can have a distance p (see FIG. 20) from a center of the end portion of the first bypass pipe 77 gradually increasing in a direction away from a connecting portion with the first bypass pipe 77. The second outer circumferential surface 791 can be sequentially divided into a second convex section j1 and a second concave section j2 in order of an increase in a distance from the connecting portion with the first bypass pipe 77. In some implementations, unlike the first outer circumferential surface 771, it is illustrated that the second outer circumferential surface 791 has an inflection point (boundary between the second concave section and the second convex section) instead of an inflection section. However, the second outer circumferential surface can also have the inflection section like the second outer circumferential surface.

Figure 20:
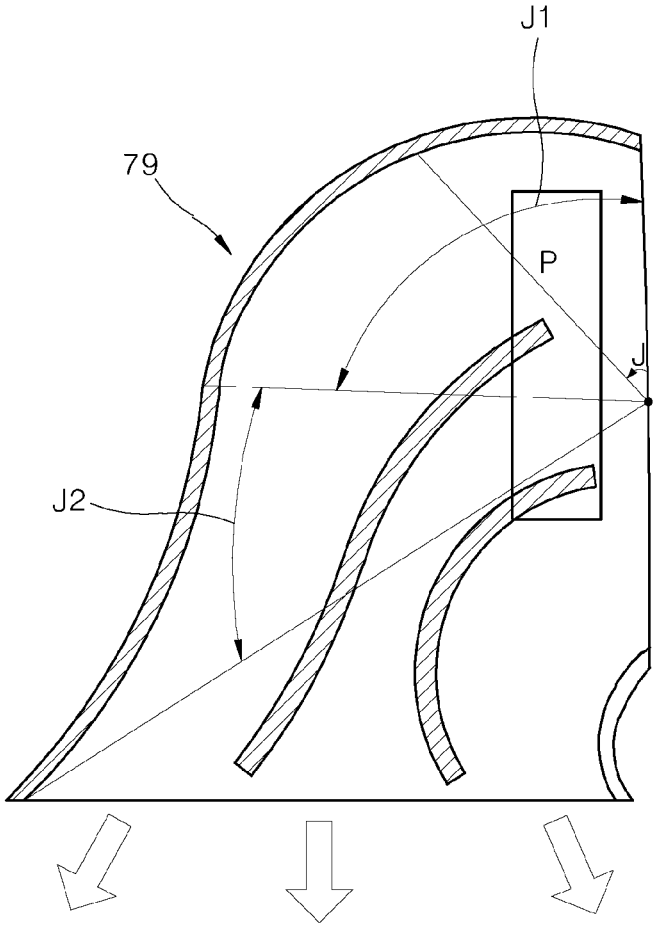
FIG. 20 is a view illustrating an example portion of a second bypass pipe in FIG. 18.
Figure 21:
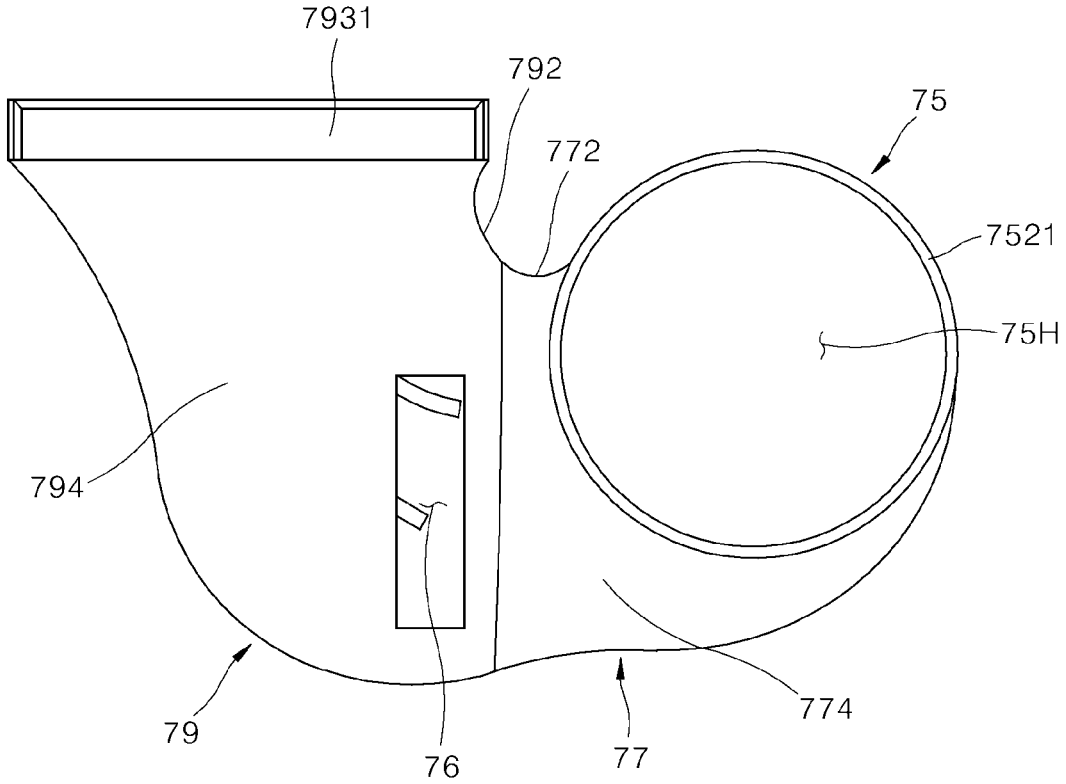
FIG. 21 is a bottom view illustrating the distribution cap.

The second convex section j1 is a section having a convex curved surface. Referring to FIG. 20, in this section, it can be expressed as $dp/dj>0$ and $d^2p/dj^2<0$. This shape allows a flow resistance to be minimized and allows a flow direction of dry air flowing from the first bypass pipe 77 toward the second bypass pipe 79 to be changed to the second lateral direction quickly.

The second concave section j2 is a section having a concave surface. In this section, it can be expressed as $dp/dj>0$ and $d^2p/dj^2>0$. This shape corresponds to a section in which a flow cross section of the air directed in the second lateral direction is expanded, and thus, it is advantageous for more widely diffusing dry air.

The second inner circumferential surface 792 has a curved surface in which a curve direction of the first inner circumferential surface 772 connected to the second inner circumferential surface 792 is continued. The second inner circumferential surface 792 also becomes a section expanding a flow cross section of air. That is, both of the first inner circumferential surface 772 and the second inner circumferential surface 792 have concave profiles.

Figure 22:
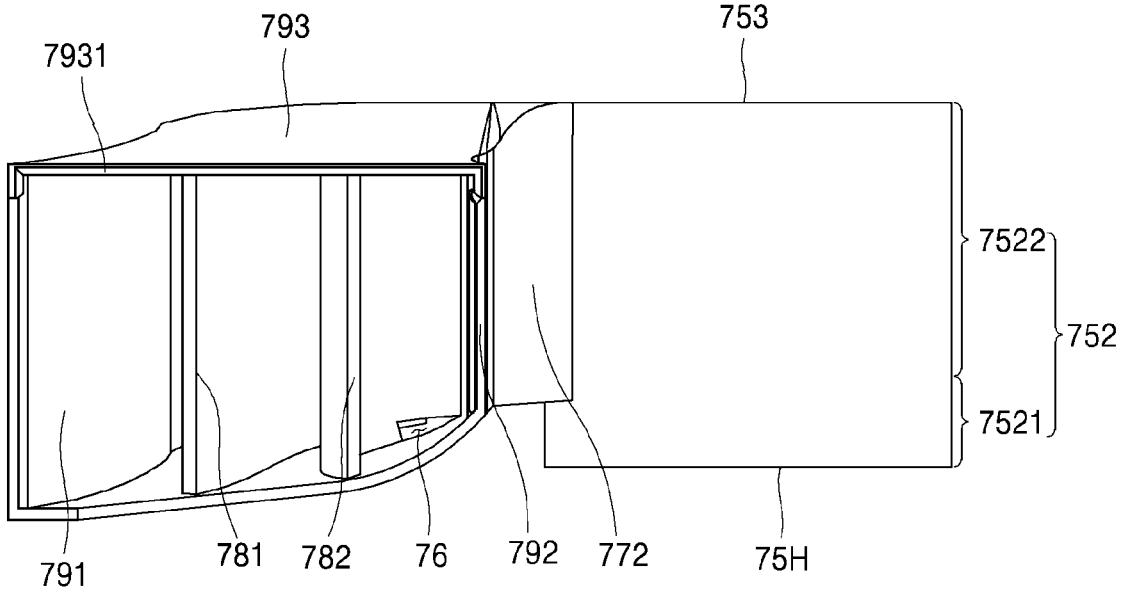
FIG. 22 is a front view illustrating the distribution cap.
Figure 23:
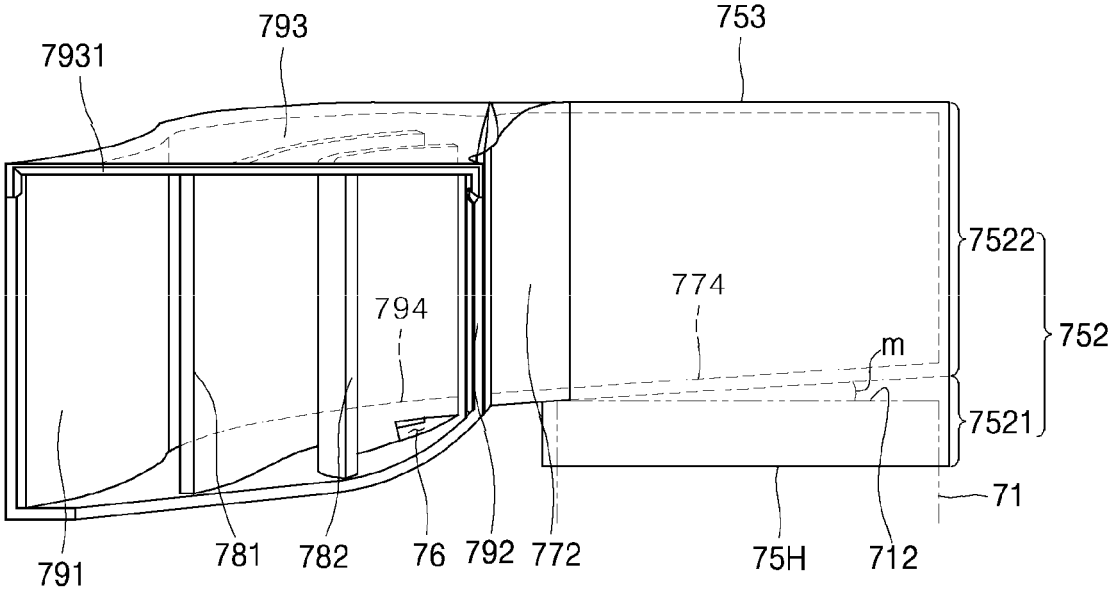
FIG. 23 is a perspective view illustrating the distribution cap of FIG. 22.
Figure 24:
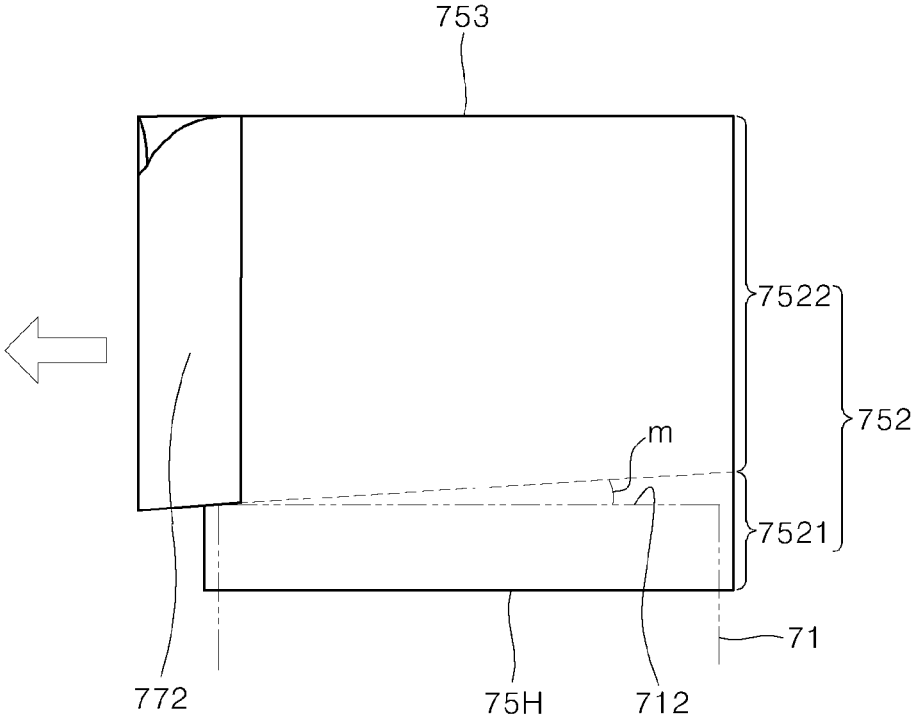
FIG. 24 is a view illustrating example portions of the fitting pipe and the first bypass pipe in FIG. 23.
Figure 25:
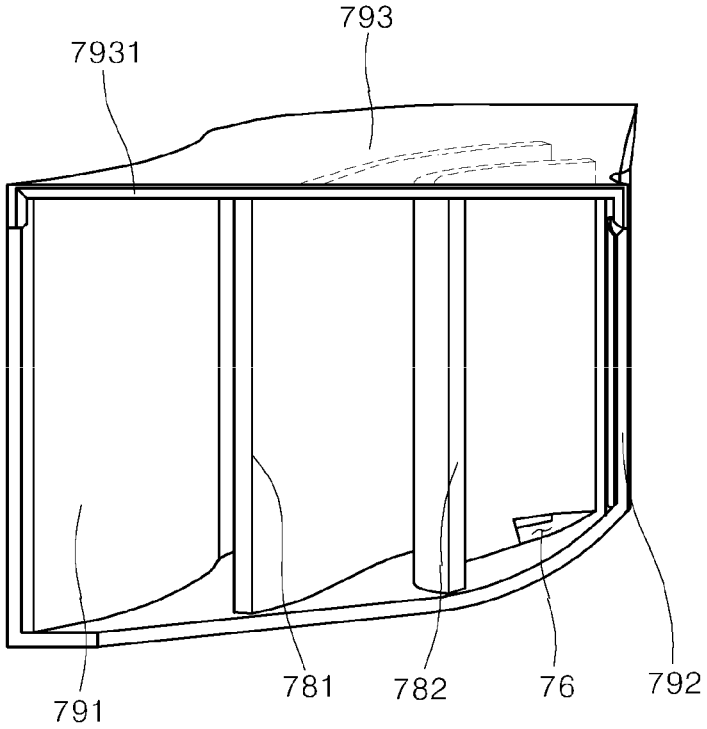
FIG. 25 is a view illustrating an example portion of the second bypass pipe in FIG. 23.
Figure 26:
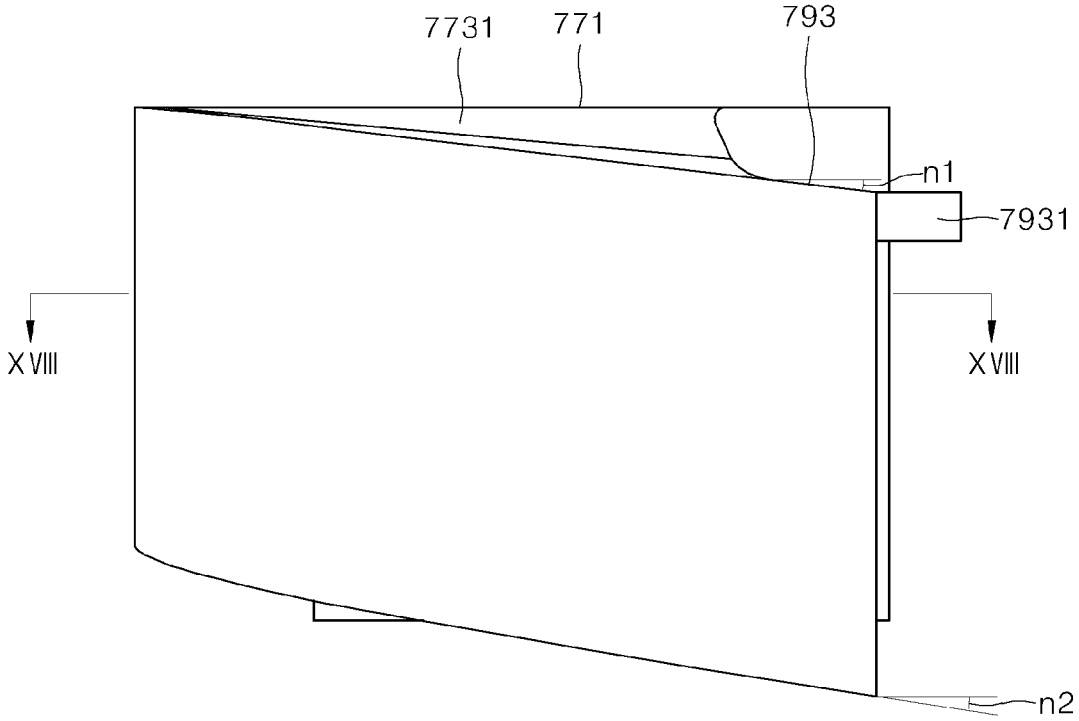
FIG. 26 is a side view illustrating the distribution cap.
Figure 27:
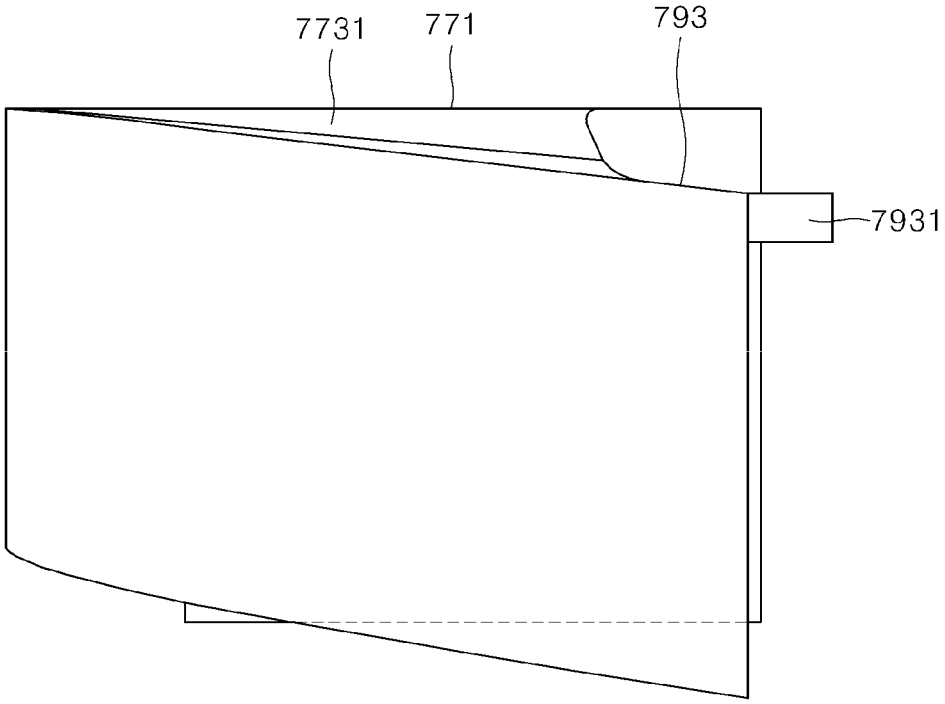
FIG. 27 is a perspective view illustrating the distribution cap of FIG. 26.

As illustrated in FIGS. 22, 23, and 25, the second inner circumferential surface 792 can extend very shortly from the first inner circumferential surface 772 or can be omitted.

The second bottom surface 794 can be an inclined surface extending downward in the first lateral direction and can be a surface inclined downward in the second lateral direction. An inclination angle m of the second bottom surface 794 in the first lateral direction can be an angle corresponding to the inclination angle of the first bottom surface. Accordingly, the first bottom surface 774 and the second bottom surface 794 can be smoothly connected to induce wash water permeating into the distribution cap 72 to flow smoothly downward.

An angle n2 of the second bottom surface 794 inclined in the second lateral direction can be greater than the inclination angle n1 of the second upper surface 793. Accordingly, an effect of increasing a flow cross-sectional area of dry air in the second lateral direction can be obtained, and the inclination angle n2 of the second bottom surface 794 can increase to induce the wash water permeating into the distribution cap 72 to flow smoothly downward.

An end portion of the second bypass pipe 79 defines the discharge opening 74. The discharge opening 74 is open in the second lateral direction.

An end portion of the second upper surface 793 can further include an eave 7931. The eave 7931 further extends from the end portion of the second upper surface 793 in the second lateral direction. The eave 7931 blocks the wash water from being introduced into the discharge opening 74 to some extent but does not hinder the flow of the dry air which is discharged through the discharge opening 74. The eave 7931 can extend horizontally.

Vanes 78 can be provided between the second outer circumferential surface 791 and the second inner circumferential surface 792. The vanes 78 prevent a phenomenon in which dry air flowing from the first bypass pipe 77 toward the second bypass pipe 79 is concentrated at a side of the second outer circumferential surface 791 and flows, and the vanes 78 guide the dry air to be widely diffused and discharged from the discharge opening 74.

Upper end portions and lower end portions of the vanes 78 are connected to the second upper surface 793 and the second bottom surface 794. The vanes 78 include an outer vane 781 disposed closer to the second outer circumferential surface 791 and an inner vane 782 disposed closer to the second inner circumferential surface 792. A profile of the outer vane 781 corresponds to a profile of the second outer circumferential surface 791, and a profile of the inner vane 782 corresponds to the profile of the second inner circumferential surface 792.

Dry air discharged from a space between the outer vane 781 and the inner vane 782 is directed in the second lateral direction. In addition, dry air discharged from the space between the outer vane 781 and the second outer circumferential surface 791 is directed in the second lateral direction and the first lateral direction. In addition, dry air discharged from the space between the inner vane 782 and the second inner circumferential surface 792 is directed in the second lateral direction and directed in a direction opposite to the first lateral direction.

A direction of an overall dry air flow path of the distribution cap 72 from the fitting pipe 75 is changed to the direction opposite to the second lateral direction, the first lateral direction, and the second lateral direction. Accordingly, dry air discharged from the distribution cap 72 can swirl to be uniformly diffused in the washing space 20S of the tub 20.

In some examples, a drain hole 76 is provided in a start portion of the second bottom surface 794 connected to the first bottom surface 774. The drain hole 76 is formed to extend along a boundary between the first bottom surface 774 and the second bottom surface 794. The drain hole 76 allows the wash water splashed into the second bypass pipe 79 through the discharge opening 74 and moved upward along the second bottom surface 794 to be discharged through the drain hole 76 so as to prevent the wash water from being introduced into the nozzle 71.

The drain hole 76 is positioned just under the second upper surface 793 adjacent to the transition section 7731. Even when the wash water splashed therein from the outside collides with the second upper surface 793 and moves toward the first bypass pipe 77 along the second upper surface 793, since there is a change in inclination between the second upper surface 793 and the transition section 7731, the wash water, which is entering along the second upper surface 793, does not move along a ceiling surface upward any farther and falls downward. Since the drain hole 76 is disposed just under a portion at which the change in inclination starts, the wash water can be easily discharged through the drain hole 76. That is, the transition section 7731 serves two functions of preventing infiltration of the wash water and reducing a dry air flow resistance.

According to the distribution cap 72, an open direction of the discharge opening 74 is opposite to an open direction of the open part 753 of the fitting pipe 75 in a state in which the discharge opening 74 is eccentrically disposed with respect thereto. Accordingly, almost all of the wash water splashed thereinto through the discharge opening 74 at a predetermined flow rate collides with an inner surface of the second outer circumferential surface 791 and the vanes 78 so that it is difficult for the wash water to be introduced into the first bypass pipe 77.

Accordingly, when the distribution cap 72 is used, the upper portion of the nozzle 71 does not need to be closed in order to prevent the water from splashing into the nozzle 71. That is, the nozzle 71 can also be completely open upward.

Accordingly, when the nozzle 71 is installed in the tub 20, since a circumferential direction of the nozzle 71 does not need to be aligned, assembly of the nozzle 71 is very easy, and even when the distribution cap 72 is installed on the upper portion of the nozzle 71, a circumferential direction of the distribution cap 72 does not need to be relatively aligned with the nozzle 71, and it is enough to align a direction in which the discharge opening 74 of the distribution cap 72 is directed in the tub 20 and to install the distribution cap 72 on the nozzle 71.

Although the present disclosure has been described with reference to the accompanying drawings as described above, the present disclosure is not limited by the implementations and drawings illustrated in the present specification, and it is clear that the present disclosure is variously modified by those skilled in the art within a range of the technical spirit of the present disclosure. In addition, while the implementations of the present disclosure have been described, although the operational effects according to the structure of the present disclosure have not been clearly described, predictable effects according to the corresponding structure should also be recognized.

What is claimed is:

1. A cap configured to couple to a nozzle of a dish washer and to guide air from the nozzle to be discharged in a discharge direction, the cap comprising:

a fitting pipe configured to couple to the nozzle;

a first bypass pipe that is connected to the fitting pipe and extends in a direction different from the discharge direction, the first bypass pipe being configured to be positioned above the nozzle based on the fitting pipe being coupled to the nozzle; and a second bypass pipe that extends from an end portion of the first bypass pipe in the discharge direction, the second bypass pipe defining a discharge opening at an end portion thereof, wherein the first bypass pipe defines an inner space thereof and comprises:

a first outer circumferential surface that faces the inner space of the first bypass pipe and defines a first portion of an outer circumference of the first bypass pipe, and a connecting portion connected to the fitting pipe, and wherein the first outer circumferential surface comprises a convex section and a concave section, the convex section being disposed between the connecting portion and the concave section.

2. The cap of claim 1, wherein the fitting pipe comprises:

a sidewall comprising (i) a fitting section configured to engage with the nozzle and (ii) an upper section that extends upward from the fitting section and defines an open part that is open in a direction different from the discharge direction; and an upper end cover that covers the upper section of the sidewall, and wherein the first bypass pipe is connected to the fitting pipe and in fluid communication with the open part of the upper section of the sidewall.

3. The cap of claim 1, wherein the first bypass pipe further comprises a first bottom surface that defines a lower limit of the inner space of the first bypass pipe, the first bottom surface extending along an extension direction inclined downward with respect to a horizontal plane.

4. The cap of claim 1, wherein the first bypass pipe further comprises:

a first inner circumferential surface that defines a second portion of the outer circumference of the first bypass pipe, the first inner circumferential surface being disposed radially inward relative to the first outer circumferential surface, and wherein a length of the first outer circumferential surface is greater than a length of the first inner circumferential surface.

5. The cap of claim 4, wherein a distance between the first outer circumferential surface and a center of the fitting pipe increases in a direction away from the connecting portion.

6. The cap of claim 1, wherein the first bypass pipe extends in a first lateral direction that intersects the discharge direction.

7. The cap of claim 1, wherein the second bypass pipe defines an inner space thereof and comprises a bottom surface that defines a lower limit of the inner space of the second bypass pipe, the bottom surface of the second bypass pipe extending along an extension direction inclined downward with respect to a horizontal plane.

8. The cap of claim 7, wherein the first bypass pipe further comprises a bottom surface that defines a lower limit of the inner space of the first bypass pipe, the bottom surface of the first bypass pipe being inclined downward with respect to the horizontal plane and extending in a first lateral direction intersecting the discharge direction, wherein the bottom surface of the second bypass pipe is inclined downward with respect to the horizontal plane in each of the first lateral direction and the discharge direction, and wherein the bottom surface of each of the first bypass pipe and the second bypass pipe defines an inclination angle inclined downward with respect to the horizontal plane in the first lateral direction.

9. The cap of claim 7, wherein an upper surface of the second bypass pipe defines an upper limit of the inner space of the second bypass pipe, the upper surface of the second bypass pipe extending in the discharge direction and defining an upper inclination angle inclined with respect to the horizontal plane, and wherein the bottom surface of the second bypass pipe extends in the discharge direction and defines a lower inclination angle inclined with respect to the horizontal plane, the lower inclination angle being greater than the upper inclination angle.

10. The cap of claim 1, wherein the second bypass pipe defines an inner space and comprises:

an upper surface that defines an upper limit of the inner space of the second bypass pipe; and an eave that is disposed at an end portion of the upper surface of the second bypass pipe and extends in the discharge direction.

11. The cap of claim 1, wherein the second bypass pipe defines an inner space and comprises:

an outer circumferential surface that defines a first portion of an outer circumference of the second bypass pipe and faces the inner space of the second bypass pipe; and an inner circumferential surface that defines a second portion of the outer circumference of the second bypass pipe, the inner circumferential surface being disposed radially inward relative to the outer circumferential surface, and wherein a length of the outer circumferential surface of the second bypass pipe is greater than a length of the inner circumferential surface of the second bypass pipe.

12. The cap of claim 11, wherein the second bypass pipe further comprises a connecting portion connected to the first bypass pipe, and wherein a distance between the outer circumferential surface of the second bypass pipe and a center of the end portion of the first bypass pipe increases in a direction away from the connecting portion of the second bypass pipe.

13. The cap of claim 12, wherein the outer circumferential surface of the second bypass pipe comprises a convex section and a concave section, the convex section of the second bypass pipe being disposed between the connecting portion of the second bypass pipe and the concave section of the second bypass pipe.

14. The cap of claim 11, wherein the inner circumferential surface of the second bypass pipe has a concave profile.

15. The cap of claim 14, wherein the inner circumferential surface of the second bypass pipe is curved to expand at least a partial section from the discharge opening.

16. The cap of claim 11, wherein the second bypass pipe further comprises an outer vane and an inner vane that are disposed between the outer circumferential surface of the second bypass pipe and the inner circumferential surface of the second bypass pipe, wherein the outer vane defines a profile corresponding to the outer circumferential surface of the second bypass pipe and is disposed at a position closer to the outer circumferential surface of the second bypass pipe than the inner circumferential surface of the second bypass pipe, and wherein the inner vane defines a profile corresponding to the inner circumferential surface of the second bypass pipe and is disposed at a position closer to the inner circumferential surface of the second bypass pipe than the outer circumferential surface of the second bypass pipe.

17. The cap of claim 1, wherein the first bypass pipe defines a first inner space and comprises a first upper surface that defines an upper limit of the first inner space, wherein the second bypass pipe defines a second inner space and comprises a second upper surface that defines an upper limit of the second inner space, the second upper surface extending in the discharge direction and being inclined downward with respect to a horizontal plane, wherein the first upper surface is disposed above the second upper surface, and wherein the cap further comprises a transition section that connects the first upper surface and the second upper surface, the transition section defining a streamlined shape at a boundary between the first upper surface and the second upper surface.

18. The cap of claim 17, wherein the cap defines a drain hole at a bottom region facing the transition section.

19. A dish washer comprising:

a tub;

a nozzle; and a cap which is coupled to the nozzle and is configured to guide air from the nozzle to the tub to be discharged in a discharge direction, the cap comprising:

a fitting pipe coupled to the nozzle;

a first bypass pipe that is connected to the fitting pipe and extends in a direction different from the discharge direction, the first bypass pipe being positioned above the nozzle based on the fitting pipe being coupled to the nozzle; and a second bypass pipe that extends from an end portion of the first bypass pipe in the discharge direction, the second bypass pipe defining a discharge opening at an end portion thereof, wherein the first bypass pipe defines an inner space thereof and comprises:

a first outer circumferential surface that faces the inner space of the first bypass pipe and defines a first portion of an outer circumference of the first bypass pipe, and a connecting portion connected to the fitting pipe, and wherein the first outer circumferential surface comprises a first convex section and a first concave section, the first convex section being disposed between the connecting portion and the first concave section.

20. A cap configured to couple to a nozzle of a dish washer and to guide air from the nozzle to be discharged in a discharge direction, the cap comprising:

a fitting pipe configured to couple to the nozzle;

a first bypass pipe that is connected to the fitting pipe and extends in a direction different from the discharge direction, the first bypass pipe being configured to be positioned above the nozzle based on the fitting pipe being coupled to the nozzle; and a second bypass pipe that extends from an end portion of the first bypass pipe in the discharge direction, the second bypass pipe defining a discharge opening at an end portion thereof, wherein the first bypass pipe defines a first inner space and comprises a first upper surface that defines an upper limit of the first inner space, wherein the second bypass pipe defines a second inner space and comprises a second upper surface that defines an upper limit of the second inner space, the second upper surface extending in the discharge direction and being inclined downward with respect to a horizontal plane, wherein the first upper surface is disposed above the second upper surface, and wherein the cap further comprises a transition section that connects the first upper surface and the second upper surface, the transition section defining a streamlined shape at a boundary between the first upper surface and the second upper surface.

* * * * *